US010347268B2

(12) United States Patent
Franck et al.

(10) Patent No.: US 10,347,268 B2
(45) **Date of Patent: *Jul. 9, 2019**

(54) DEVICE AND METHOD FOR CALCULATING LOUDSPEAKER SIGNALS FOR A PLURALITY OF LOUDSPEAKERS WHILE USING A DELAY IN THE FREQUENCY DOMAIN

(71) Applicant: FRAUNHOFER-GESELLSCHAFT ZUR FOERDERUNG DER ANGEWANDTEN FORSCHUNG E.V., Munich (DE)

(72) Inventors: Andreas Franck, Southampton (GB); Michael Rath, Eurfurt (DE); Christoph Sladeczek, Ilmenau (DE)

(73) Assignee: FRAUNHOFER-GESELLSCHAFT ZUR FOERDERUNG DER ANGEWANDTEN FORSCHUNG E.V., Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/603,946

(22) Filed: May 24, 2017

(65) Prior Publication Data

US 2018/0012612 A1 Jan. 11, 2018
US 2018/0358029 A9 Dec. 13, 2018

Related U.S. Application Data

(63) Continuation of application No. 14/329,457, filed on Jul. 11, 2014, now Pat. No. 9,666,203, which is a (Continued)

(30) Foreign Application Priority Data

Jan. 13, 2012 (DE) ..... 10 2012 200 512

(51) Int. Cl.
*H04R 3/12* (2006.01)
*G10L 19/26* (2013.01)
*H04R 29/00* (2006.01)

(52) U.S. Cl.
CPC ..... *G10L 19/26* (2013.01); *H04R 3/12* (2013.01); *H04R 29/001* (2013.01); (Continued)

(58) Field of Classification Search
None
See application file for complete search history.

(56) References Cited

U.S. PATENT DOCUMENTS

2007/0223751 A1 9/2007 Dickins et al.
2013/0216070 A1* 8/2013 Keiler ..... G10L 19/008 381/300

(Continued)

FOREIGN PATENT DOCUMENTS

JP 2001-509610 A 7/2001
JP 2002-508616 A 3/2002

(Continued)

OTHER PUBLICATIONS

Japanese Decision to Grant a Patent issued in corresponding Japanese Patent Application No. 2015-249310 dated Oct. 31, 2017.

*Primary Examiner* — Curtis A Kuntz
*Assistant Examiner* — Kenny H Truong
(74) *Attorney, Agent, or Firm* — Squire Patton Boggs (US) LLP

(57) ABSTRACT

A device for calculating loudspeaker signals for a plurality of loudspeakers while using a plurality of audio sources, an audio source including an audio signal, includes a forward transform stage for transforming each audio signal, block-by-block, to a spectral domain so as to obtain for each audio signal a plurality of temporally consecutive short-term spec- (Continued)

tra, a memory for storing a plurality of temporally consecutive short-term spectra for each audio signal, a memory access controller for accessing a specific short-term spectrum among the plurality of short-term spectra for a combination consisting of a loudspeaker and an audio signal on the basis of a delay value, a filter stage for filtering the specific short-term spectrum for the combination of the audio signal and the loudspeaker by using a filter provided for the combination of the audio signal and the loudspeaker, so that a filtered shot-term spectrum is obtained for each combination of an audio signal and a loudspeaker, a summing stage for summing up the filtered short-term spectra for a loudspeaker so as to obtain summed-up short-term spectra for each loudspeaker, and a backtransform stage for backtransforming, block-by-block, summed-up short-term spectra for the loudspeakers to a time domain so as to obtain the loudspeaker signals.

13 Claims, 14 Drawing Sheets

Related U.S. Application Data continuation of application No. PCT/EP2012/077075, filed on Dec. 28, 2012.

(52) U.S. Cl.
CPC ..... *H04R 2430/03* (2013.01); *H04S 2420/07* (2013.01); *H04S 2420/13* (2013.01)

(56) References Cited

U.S. PATENT DOCUMENTS

| | | | |
|---|---|---|---|
| 2013/0243203 | A1 | 9/2013 | Franck et al. |
| 2014/0064494 | A1 | 3/2014 | Mahabub et al. |

FOREIGN PATENT DOCUMENTS

| | | | |
|---|---|---|---|
| JP | 2010-520671 | A | 6/2010 |
| JP | 2010-539833 | A | 12/2010 |
| WO | 99/01953 | A1 | 1/1999 |

* cited by examiner

| OS 301 | AS1 | STS 3 | -2B |
|---|---|---|---|
| OS 304 | AS1 | STS 1 | 0 |
| OS 302 | AS2 | STS 6 | -5B |
| OS 308 | AS2 | STS 7 | -6B |
| OS 303 | AS3 | STS 2 | -B |
| audio signal/ LS combination | audio signal | specific STS | delay |

270

DEVICE AND METHOD FOR CALCULATING LOUDSPEAKER SIGNALS FOR A PLURALITY OF LOUDSPEAKERS WHILE USING A DELAY IN THE FREQUENCY DOMAIN

CROSS-REFERENCE TO RELATED APPLICATIONS

This application is a continuation of U.S. patent application Ser. No. 14/329,457, filed Jul. 11, 2014, which is a continuation of copending International Application No. PCT/EP2012/077075, filed Dec. 28, 2012, which is incorporated herein by reference in its entirety, and additionally claims priority from German Application No. 102012200512.9, filed Jan. 13, 2012, which is also incorporated herein by reference in its entirety.

FIELD OF INVENTION

The present invention relates to a device and method for calculating loudspeaker signals for a plurality of loudspeakers while using filtering in the frequency domain such as a wave field synthesis renderer device and a method of operating such a device.

BACKGROUND OF THE INVENTION

In the field of consumer electronics there is a constant demand for new technologies and innovative products. An example here is reproducing audio signals as realistically as possible.

Methods of multichannel loudspeaker reproduction of audio signals have been known and standardized for many years. All conventional technologies have the disadvantage that both the positions of the loudspeakers and the locations of the listeners are already impressed onto the transmission format. If the loudspeakers are arranged incorrectly with regard to the listener, the audio quality will decrease significantly. Optimum sound is only possible within a small part of the reproduction space, the so-called sweet spot.

An improved natural spatial impression and increased envelopment in audio reproduction may be achieved with the aid of a new technique. The basics of said technique, so-called wave field synthesis (WFS), were investigated at the Technical University of Delft and were presented for the first time in the late 1980s (Berkhout, A. J.; de Vries, D.; Vogel, P.: Acoustic Control By Wavefield Synthesis. JASA 93, 1993).

As a result of the enormous requirements said method has placed upon computer performance and transmission rates, wave field synthesis has only been rarely used in practice up to now. It is only the progress made in the fields of microprocessor technology and audio coding that by now allow said technique to be used in specific applications.

The fundamental idea of WFS is based on applying Huygen's principle of wave theory: each point that is hit by a wave is a starting point of an elementary wave, which propagates in the shape of a sphere or a circle.

When applied to acoustics, any sound field may be replicated by using a large number of loudspeakers arranged adjacently to one another (a so-called loudspeaker array). To this end the audio signal of each loudspeaker is generated from the audio signal of the source by applying a so-called WFS operator. In the simplest case, e.g., when reproducing a point source and a linear loudspeaker array, the WFS operator will correspond to amplitude scaling and to a time delay of the input signal. Application of said amplitude scaling and time delay will be referred to as scale & delay below.

In the case of a single point source to be reproduced and a linear arrangement of the loudspeakers, a time delay and amplitude scaling may be applied to the audio signal of each loudspeaker so that the emitted sound fields of the individual loudspeakers will superpose correctly. In the event of several sound sources, the contribution to each loudspeaker will be calculated separately for each source, and the resulting signals will be added. If the sources to be reproduced are located in a room having reflecting walls, reflections will also have to be reproduced as additional sources via the loudspeaker array. The effort in terms of calculation will therefore highly depend on the number of sound sources, the reflection properties of the recording room, and on the number of loudspeakers.

The advantage of this technique consists, in particular, in that a natural spatial sound impression is possible across a large part of the reproduction room. Unlike the known technologies, the direction and distance of sound sources are reproduced in a highly exact manner. To a limited extent, virtual sound sources may even be positioned between the real loudspeaker array and the listener.

Application of wave field synthesis provides good results if the preconditions assumed in theory such as ideal loudspeaker characteristics, regular, unbroken loudspeaker arrays, or free-field conditions for sound propagation are at least approximately met. In practice, however, said conditions are frequently not met, e.g. due to incomplete loudspeaker arrays or a significant influence of the acoustics of a room.

A environmental condition can be described by the impulse response of the environment.

This will be set forth in more detail by means of the following example. It shall be assumed that a loudspeaker emits a sound signal against a wall, the reflection of which is undesired.

For this simple example, room compensation while using wave field synthesis would consist in initially determining the reflection of said wall in order to find out when a sound signal which has been reflected by the wall arrives back at the loudspeaker, and which amplitude this reflected sound signal has. If the reflection by this wall is undesired, wave field synthesis offers the possibility of eliminating the reflection by this wall by impressing upon the loudspeaker—in addition to the original audio signal—a signal that is opposite in phase to the reflection signal and has a corresponding amplitude, so that the forward compensation wave cancels the reflection wave such that the reflection by this wall is eliminated in the environment contemplated. This may be effected in that initially, the impulse response of the environment is calculated, and the nature and position of the wall is determined on the basis of the impulse response of this environment. This involves representing the sound that is reflected by the wall by means of an additional WFS sound source, a so-called mirror sound source, the signal of which is generated from the original source signal by means of filtering and delay.

If the impulse response of this environment is measured, and if the compensation signal that is superposed onto the audio signal and impressed onto the loudspeaker is subsequently calculated, cancellation of the reflection by this wall will occur such that a listener in this environment will have the impression that this wall does not exist at all.

However, what is decisive for optimum compensation of the reflected wave is the impulse response of the room is accurately determined, so that no overcompensation or undercompensation occurs.

Thus, wave field synthesis enables correct mapping of virtual sound sources across a large reproduction area. At the same time, it offers to the sound mixer and the sound engineer a new technical and creative potential in generating even complex soundscapes. Wave field synthesis as was developed at the Technical University of Delft at the end of the 1980s represents a holographic approach to sound reproduction. The Kirchhoff-Helmholtz integral serves as the basis for this. Said integral states that any sound fields within a closed volume may be generated by means of distributing monopole and dipole sound sources (loudspeaker arrays) on the surface of said volume.

In wave field synthesis, a synthesis signal is calculated, from an audio signal emitting a virtual source at a virtual position, for each loudspeaker of the loudspeaker array, the synthesis signals having such amplitudes and delays that a wave resulting from the superposition of the individual sound waves output by the loudspeakers existing within the loudspeaker array corresponds to the wave that would result from the virtual source at the virtual position if said virtual source at the virtual position were a real source having a real position.

Typically, several virtual sources are present at different virtual positions. The synthesis signals are calculated for each virtual source at each virtual position, so that typically, a virtual source results in synthesis signals for several loudspeakers. From the point of view of one loudspeaker, said loudspeaker will thus receive several synthesis signals stemming from different virtual sources. Superposition of said sources, which is possible due to the linear superposition principle, will then yield the reproduction signal actually emitted by the loudspeaker.

The possibilities of wave field synthesis may be exhausted all the more, the larger the size of the loudspeaker arrays, i.e. the larger the number of individual loudspeakers provided. However, this also results in an increase in the computing performance that a wave field synthesis unit supplies since, typically, channel information is also taken into account. Specifically, this means that in principle, a dedicated transmission channel exists from each virtual source to each loudspeaker, and that in principle, the case may exist where each virtual source leads to a synthesis signal for each loudspeaker, and/or that each loudspeaker obtains a number of synthesis signals which is equal to the number of virtual sources.

If the possibilities of wave field synthesis are to be exhausted, specifically, in cinema applications to the effect that the virtual sources can also be movable, it has to be noted that quite substantial computing operations have to be effected because of the calculation of the synthesis signals, the calculation of the channel information, and the generation of the reproduction signals by combining the channel information and the synthesis signals.

A further important expansion of wave field synthesis consists in reproducing virtual sound sources with complex, frequency-dependent directional characteristics. For each source/loudspeaker combination, convolution of the input signal by means of a specific filter is also taken into account in addition to a delay, which will then typically exceed the computing expenditure in existing systems.

SUMMARY

According to an embodiment, a device for calculating loudspeaker signals for a plurality of loudspeakers while using a plurality of audio sources, an audio source having an audio signal, may have: a forward transform stage for transforming each audio signal, block-by-block, to a spectral domain so as acquire for each audio signal a plurality of temporally consecutive short-term spectra; a memory for storing a plurality of temporally consecutive short-term spectra for each audio signal; a memory access controller for accessing a specific short-term spectrum among the plurality of temporally consecutive short-term spectra for a combination having a loudspeaker and an audio signal on the basis of a delay value; a filter stage for filtering the specific short-term spectrum for the combination of the audio signal and the loudspeaker by using a filter provided for the combination of the audio signal and the loudspeaker, so that a filtered shot-term spectrum is acquired for each combination of an audio signal and a loudspeaker; a summing stage for summing up the filtered short-term spectra for a loudspeaker so as acquire summed-up short-term spectra for each loudspeaker; and a backtransform stage for backtransforming, block-by-block, summed-up short-term spectra for the loudspeakers to a time domain so as acquire the loudspeaker signals.

According to another embodiment, a method of calculating loudspeaker signals for a plurality of loudspeakers while using a plurality of audio sources, an audio source having an audio signal, may have the steps of: transforming each audio signal, block-by-block, to a spectral domain so as acquire for each audio signal a plurality of temporally consecutive short-term spectra; storing a plurality of temporally consecutive short-term spectra for each audio signal; accessing a specific short-term spectrum among the plurality of temporally consecutive short-term spectra for a combination having a loudspeaker and an audio signal on the basis of a delay value; filtering the specific short-term spectrum for the combination of the audio signal and the loudspeaker by using a filter provided for the combination of the audio signal and the loudspeaker, so that a filtered shot-term spectrum is acquired for each combination of an audio signal and a loudspeaker; summing up the filtered short-term spectra for a loudspeaker so as acquire summed-up short-term spectra for each loudspeaker; and backtransforming, block-by-block, summed-up short-term spectra for the loudspeakers to a time domain so as acquire the loudspeaker signals.

Another embodiment may have a computer program having a program code for performing the method as claimed in claim 12 when the program code runs on a computer or processor.

The present invention is advantageous in that it provides, due to the combination of a forward transform stage, a memory, a memory access controller, a filter stage, a summing stage, and a backtransform stage, an efficient concept characterized in that the number of forward and backtransform calculations need not be performed for each individual combination of audio source and loudspeaker, but only for each individual audio source.

Similarly, backtransform need not be calculated for each individual audio signal/loudspeaker combination, but only for the number of loudspeakers. This means that the number of forward transform calculations equals the number of audio sources, and the number of backward transform calculations equals the number of loudspeaker signals and/or of the loudspeakers to be driven when a loudspeaker signal drives a loudspeaker. In addition, it is particularly advantageous that the introduction of a delay in the frequency domain is efficiently achieved by a memory access controller in that on the basis of a delay value for an audio signal/loudspeaker combination, the stride used in the transform is advantageously used for said purpose. In particular, the forward transform stage provides for each audio signal a sequence of short-term spectra (STS) that are stored in the memory for each audio signal. The memory access controller thus has access to a sequence of temporally consecutive short-term spectra. On the basis of the delay value, from the sequence of short-term spectra that short-term spectrum is then selected, for an audio signal/loudspeaker combination, which best matches the delay value provided by, e.g., a wave field synthesis operator. For example, if the stride value in the calculation of the individual blocks from one short-term spectrum to the next short-term spectrum is 20 ms, and if the wave field synthesis operator may use a delay of 100 ms, said entire delay may easily be implemented by not using, for the audio signal/loudspeaker combination considered, the most recent short-term spectrum in the memory but that short-term spectrum which is also stored and is the fifth one counting backwards. Thus, the inventive device is already able to implement a delay solely on the basis of the stored short-term spectra within a specific raster (grid) determined by the stride. If said raster is already sufficient for a specific application, no further measures need to be taken. However, if a finer delay control may be used, it may also be implemented, in the frequency domain, in that in the filter stage, for filtering a specific short-term spectrum, one uses a filter, the impulse response of which has been manipulated with a specific number of zeros at the beginning of the filter impulse response. In this manner, finer delay granulation may be achieved, which now does not take place in time durations in accordance with the block stride, as is the case in the memory access controller, but in a considerably finer manner in time durations in accordance with a sampling period, i.e. with the time distance between two samples. If, in addition, even finer granulation of the delay may be used, it may also be implemented, in the filter stage, in that the impulse response, which has already been supplemented with zeros, is implemented while using a fractional delay filter. In embodiments of the present invention, thus, any delay values that may be used may be implemented in the frequency domain, i.e. between the forward transform and the backward transform, the major part of the delay being achieved simply by means of a memory access control; here, granulation is already achieved which is in accordance with the block stride and/or in accordance with the time duration corresponding to a block stride. If finer delays may be used, said finer delays are implemented by modifying, in the filter stage, the filter impulse response for each individual combination of audio signal and loudspeaker in such a manner that zeros are inserted at the beginning of the impulse response. This represents a delay in the time domain, as it were, which delay, however, is "imprinted" onto the short-term spectrum in the frequency domain in accordance with the invention, so that the delay being applied is compatible with fast convolution algorithms such as the overlap-save algorithm or the overlap-add algorithm and/or may be efficiently implemented within the framework provided by the fast convolution.

The present invention is especially suited, in particular, for static sources since static virtual sources also have statistical delay values for each audio signal/loudspeaker combination. Therefore, the memory access control may be fixedly set for each position of a virtual source. In addition, the impulse response for the specific loudspeaker/audio signal combination within each individual block of the filter stage may be preset already prior to performing the actual rendering algorithm. For this purpose, the impulse response that may actually be used for said audio signal/loudspeaker combination is modified to the effect that an appropriate number of zeros is inserted at the start of the impulse response so as to achieve a more finely resolved delay. Subsequently, this impulse response is transformed to the spectral domain and stored there in an individual filter. In the actual wave field synthesis rendering calculation, one may then resort to the stored transmission functions of the individual filters in the individual filter blocks. Subsequently, when a static source transitions from one position to the next, resetting of the memory access control and resetting of the individual filters will be useful, which, however, are already calculated in advance, e.g., when a static source transitions from one position to the next, e.g. at a time interval of 10 seconds. Thus, the frequency domain transmission functions of the individual filters may already be calculated in advance, whereas the static source is still rendered at its old position, so that when the static source is to be rendered at its new position, the individual filter stages will already have transmission functions stored therein again which were calculated on the basis of an impulse response with the appropriate number of zeros inserted.

An advantageous wave field synthesis renderer device and/or an advantageous method of operating a wave field synthesis renderer device includes N virtual sound sources providing sampling values for the source signals $x_0 \ldots x_{N-1}$, and a signal processing unit producing, from the source signals $x_0 \ldots x_{N-1}$, sampling values for M loudspeaker signals $y_0 \ldots y_{M-1}$; a filter spectrum is stored in the signal processing unit for each source/loudspeaker combination, each source signal $x_0 \ldots x_{N-1}$ using several FFT calculation blocks of the block length L is transformed into the spectra, the FFT calculation blocks comprising an overlap of the length (L-B) and a stride of the length B, each spectrum being multiplied by the associated filter spectra of the respectively same source, whereby the spectra are produced; access to the spectra being effected such that the loudspeakers are driven with a predefined delay with regard to each other in each case, said delay corresponding to an integer multiple of the stride B; all spectra of the respectively same loudspeaker i being added up, whereby the spectra $Q_j$ are produced; and each spectrum $Q_j$ is transformed, by using an IFFT calculation block, to the sampling values for the M loudspeaker signals $y_0 \ldots y_{M-1}$.

In one implementation, block-wise shifting of the individual spectra may be exploited for producing a delay in the loudspeaker signals $y_0 \ldots y_{M-1}$ by means of targeted access to the spectra. The computing expenditure for this delay depends only on the targeted access to the spectra, so that no additional computing power is required for introducing delays as long as the delay corresponds to an integer multiple of the stride B.

Overall, the invention thus relates to wave field synthesis of directional sound sources, or sound sources with directional characteristics. For real listening scenes and WFS setups consisting of several virtual sources and a large number of loudspeakers, the need to apply individual FIR filters for each combination of a virtual source and a loudspeaker frequently prevents implementation from being simple.

In order to reduce this fast increase in complexity, the invention proposes an efficient processing structure based on time/frequency techniques. Combining the components of a fast convolution algorithm into the structure of a WFS rendering system enables efficient reuse of operations and intermediate results and, thus, a considerable increase in efficiency. Even though potential acceleration increases as the number of virtual sources and loudspeakers increases, substantial savings are achieved also for WFS setups of moderate sizes. In addition, the power gains are relatively constant for a broad variety of parameter selection possibilities for the order of magnitude of filters and for the block delay value. Handling of time delays, which are inherently involved in sound reproduction techniques such as WFS, involves modification of the overlap-save technique. This is efficiently achieved by partitioning the delay value and by using frequency-domain delay lines, or delay lines implemented in the frequency domain.

Thus, the invention is not limited to rendering directional sound sources, or sound sources comprising directional characteristics, in WFS, but is also applicable to other processing tasks using an enormous amount of multichannel filtering with optional time delays.

An advantageous embodiment provides for the spectra to be produced in accordance with the overlap-save method. The overlap-save method is a method of fast convolution. This involves decomposing the input sequence $x_0 \ldots x_{N-1}$ into mutually overlapping subsequences. Following this, those portions which match the aperiodic, fast convolution are withdrawn from the periodic convolution products (cyclic convolution) that have formed.

A further advantageous embodiment provides for the filter spectra to be transformed from time-discrete impulse responses by means of an FFT. The filter spectra may be provided before the time-critical calculation steps are actually performed, so that calculation of the filter spectra does not influence the time-critical part of the calculation.

A further advantageous embodiment provides that each impulse response is preceded by a number of zeros such that the loudspeakers are mutually driven with a predefined delay which corresponds to the number of zeros. In this manner, it is possible to realize even delays which do not correspond to an integer multiple of the stride B. To this end, the desired delay is decomposed into two portions: The first portion is an integer multiple of the stride B, whereas the second portion represents the remainder. In such a decomposition, the second portion thus is invariably smaller than the stride B.

BRIEF DESCRIPTION OF THE DRAWINGS

Embodiments of the present invention will be detailed subsequently referring to the appended drawings, in which.

DETAILED DESCRIPTION OF THE INVENTION

Figure 1A:
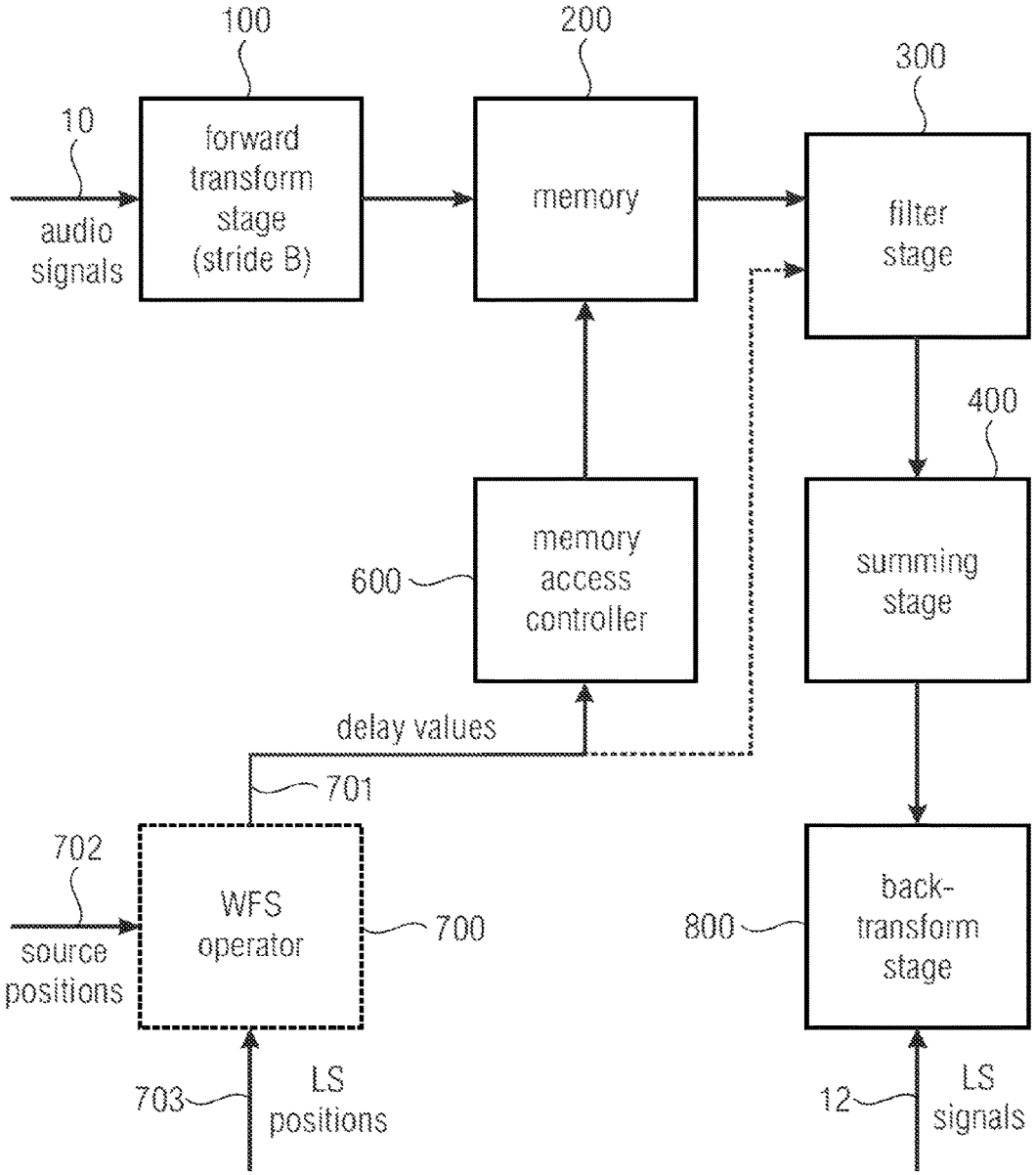
FIG. 1*a* shows a block diagram of a device for calculating loudspeaker signals in accordance with an embodiment of the present invention.

FIG. 1*a* shows a device for calculating loudspeaker signals for a plurality of loudspeakers which may be arranged, e.g., at predetermined positions within a reproduction room, while using a plurality of audio sources, an audio source comprising an audio signal 10. The audio signals 10 are fed to a forward transform stage 100 configured to perform block-wise transform of each audio signal to a spectral domain, so that a plurality of temporally consecutive short-term spectra are obtained for each audio signal. In addition, a memory 200 is provided which is configured to store a number of temporally consecutive short-term spectra for each audio signal. Depending on the implementation of the memory and the type of storage, each short-term spectrum of the plurality of short-term spectra may have a temporally ascending time value associated with it, and the memory then stores the temporally consecutive short-term spectra for each audio signal in association with the time values. However, here the short-term spectra in the memory need not be arranged in a temporally consecutive manner. Instead, the short-term spectra may be stored, e.g., in a RAM memory at any position as long as there is a table of memory content which identifies which time value corresponds to which spectrum, and which spectrum belongs to which audio signal.

Thus, the memory access controller is configured to resort to a specific short-term spectrum among the plurality of short-term spectra for a combination of loudspeaker and audio signal on the basis of a delay value predefined for this audio signal/loudspeaker combination. The specific short-term spectra determined by the memory access controller 600 are then fed to a filter stage 300 for filtering the specific short-term spectra for combinations of audio signals and loudspeakers so as to there perform filtering with a filter provided for the respective combination of audio signal and loudspeaker, and to obtain a sequence of filtered short-term spectra for each such combination of audio signal and loudspeaker. The filtered short-term spectra are then fed to a summing stage 400 by the filter stage 300 so as to sum up the filtered short-term spectra for a loudspeaker such that a summed-up short-term spectrum is obtained for each loudspeaker. The summed-up short-term spectra are then fed to a backtransform stage 800 for the purpose of block-wise backtransform of the summed-up short-term spectra for the loudspeakers so as to obtain the short-term spectra within a time domain, whereby the loudspeaker signals may be determined. The loudspeaker signals are thus output at an output 12 by the backtransform stage 800.

In one embodiment, wherein the device is a wave field synthesis device, the delay values 701 are supplied by a wave field synthesis operator (WFS operator) 700, which calculates the delay values 701 for each individual combination of audio signal and loudspeaker as a function of source positions fed in via an input 702 and as a function of the loudspeaker positions, i.e. those positions where the loudspeakers are arranged within the reproduction room, and which are supplied via an input 703. If the device is configured for a different application than for wave field synthesis, i.e. for an ambisonics implementation or the like, there will also exist an element corresponding to the WFS operator 700 which calculates delay values for individual loudspeaker signals and/or which calculates delay values for individual audio signal/loudspeaker combinations. Depending on the implementation, the WFS operator 700 will also calculate scaling values in addition to delay values, which scaling values can typically also be taken into account by a scaling factor in the filter stage 300. Said scaling values may also be taken into account by scaling the filter coefficients used in the filter stage 300, without causing any additional computing expenditure.

The memory access controller 600 may therefore be configured, in a specific implementation, to obtain delay values for different combinations of audio signal and loudspeaker, and to calculate an access value to the memory for each combination, as will be set forth with reference to FIG. 1*b*. As will also be set forth with regard to FIG. 1*b*, the filter stage 300 may be configured, accordingly, to obtain delay values for different combinations of audio signal and loudspeaker so as to calculate therefrom a number of zeros which is be taken into account in the impulse responses for the individual audios signal/loudspeaker combinations. Generally speaking, the filter stage 300 is therefore configured to implement a delay with a finer granularity in multiples of the sampling period, whereas the memory access controller 600 is configured to implement, by means of an efficient memory access operation, delays in the granularity of the stride B applied by the forward transform stage.

Figure 1B:
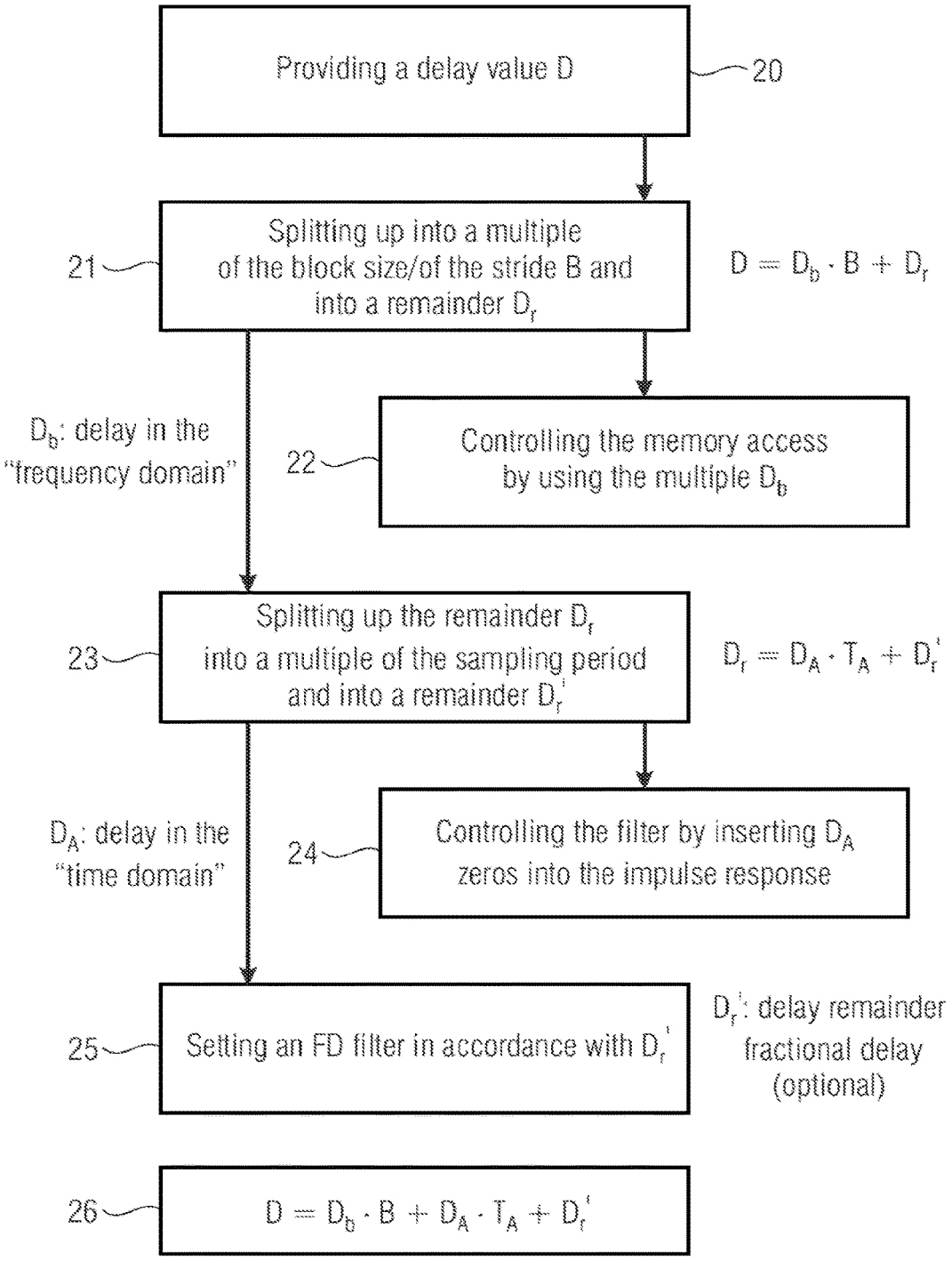
FIG. 1*b* shows an overview for determining the delays to be applied by the memory access controller and the filter stage.

FIG. 1*b* shows a sequence of functionalities that may be performed by the elements 700, 600, 300 of FIG. 1*a*.

Figure 8A:
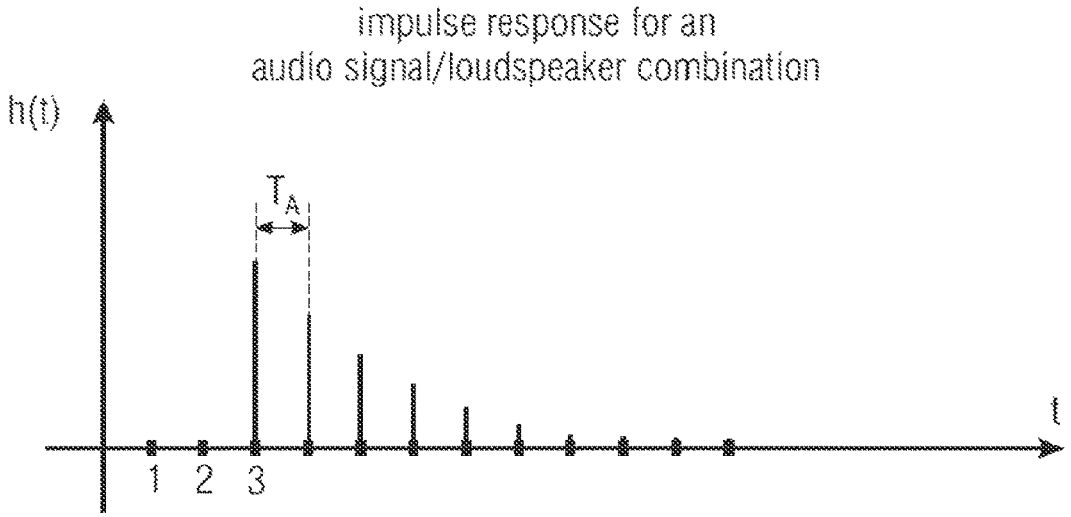
FIG. 8*a* shows an impulse response for an audio signal/loudspeaker combination.
Figure 8B:
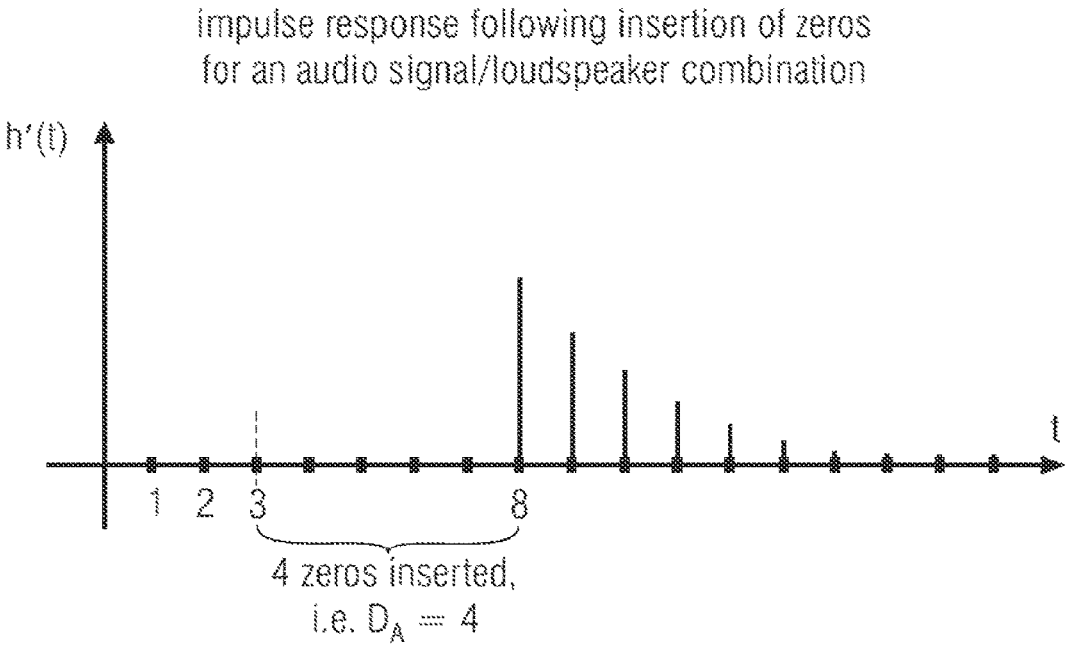
FIG. 8*b* shows an impulse response for an audio signal/loudspeaker combination following the insertion of zeros.

In particular, the WFS operator 700 is configured to provide a delay value D, as is depicted in step 20 of FIG. 1*b*. In a step 21, for example, the memory access controller 600 will split up the delay value D into a multiple of the block size and/or of the stride B and into a remainder. In particular, the delay value D equals the product consisting of the stride B and the multiple $D_b$ and the remainder. Alternatively, the multiple $D_b$, on the one hand, and the remainder $D_r$, on the other hand, can also be calculated by performing an integer division, specifically an integer division of the time duration corresponding to the delay value D and of the time duration corresponding to the stride B. The result of the integer division will then be $D_b$, and the remainder of the integer division will be $D_r$. Subsequently, the memory access controller 600 will perform, in a step 22, a control of the memory access with the multiple $D_b$, as will be explained in more detail below with reference to FIG. 9. Thus, the delay $D_b$ is efficiently implemented in the frequency domain since it is simply implemented by means of an optional access operation to a specific stored short-term spectrum selected in accordance with the delay value and/or the multiple $D_b$. In a further embodiment of the present invention, wherein a very fine delay is desired, a step 23, which is advantageously performed in the filter stage 300, comprises splitting up the remainder $D_r$ into a multiple of the sampling period $T_A$ and a remainder $D_r'$. The sampling period $T_A$, which will be explained in detail below with reference to FIGS. 8*a* and 8*b*, represents the sampling period between two values of the impulse response, which typically matches the sampling period of the discrete audio signals at the input 10 of the forward transform stage 100 of FIG. 1. The multiple $D_A$ of the sampling period $T_A$ is then used, in a step 24, for controlling the filter by inserting $D_A$ zeros in the impulse response of the filter. The remainder in the splitting-up in step 23, which is designated by $D_r'$, will then be used—when an even finer delay control may be used than may be used by the quantization of the sampling periods $T_A$ anyway—in a step 25, where a fractional-delay filter (FD filter) is set in accordance with $D_r'$. Thus, the filter into which a number of zeros have already been inserted is further configured as an FD filter.

The delay achieved by controlling the filter in step 24 may be interpreted as a delay in the "time domain" even though said delay in the frequency domain is applied, due to the specific implementation of the filter stage, to the specific short-term which has been read out—specifically while using the multiple $D_b$—from the memory 200. Thus, the result is a splitting up into three blocks for the entire delay, as is depicted at 26 in FIG. 1*b*. The first block is the time duration corresponding to the product of $D_b$, i.e. the multiple of the block size, and the block size. The second delay block is the multiple $D_A$ of the sampling time duration $T_A$, i.e. a time duration corresponding to this product $D_A \times T_A$. Subsequently, a fractional delay and/or a delay remainder $D_r'$ remains. $D_r'$ is smaller than $T_A$, and $D_A \times T_A$ is smaller than B, which is directly due to the two splitting-up equations next to blocks 21 and 23 in FIG. 1*b*.

Figure 1C:
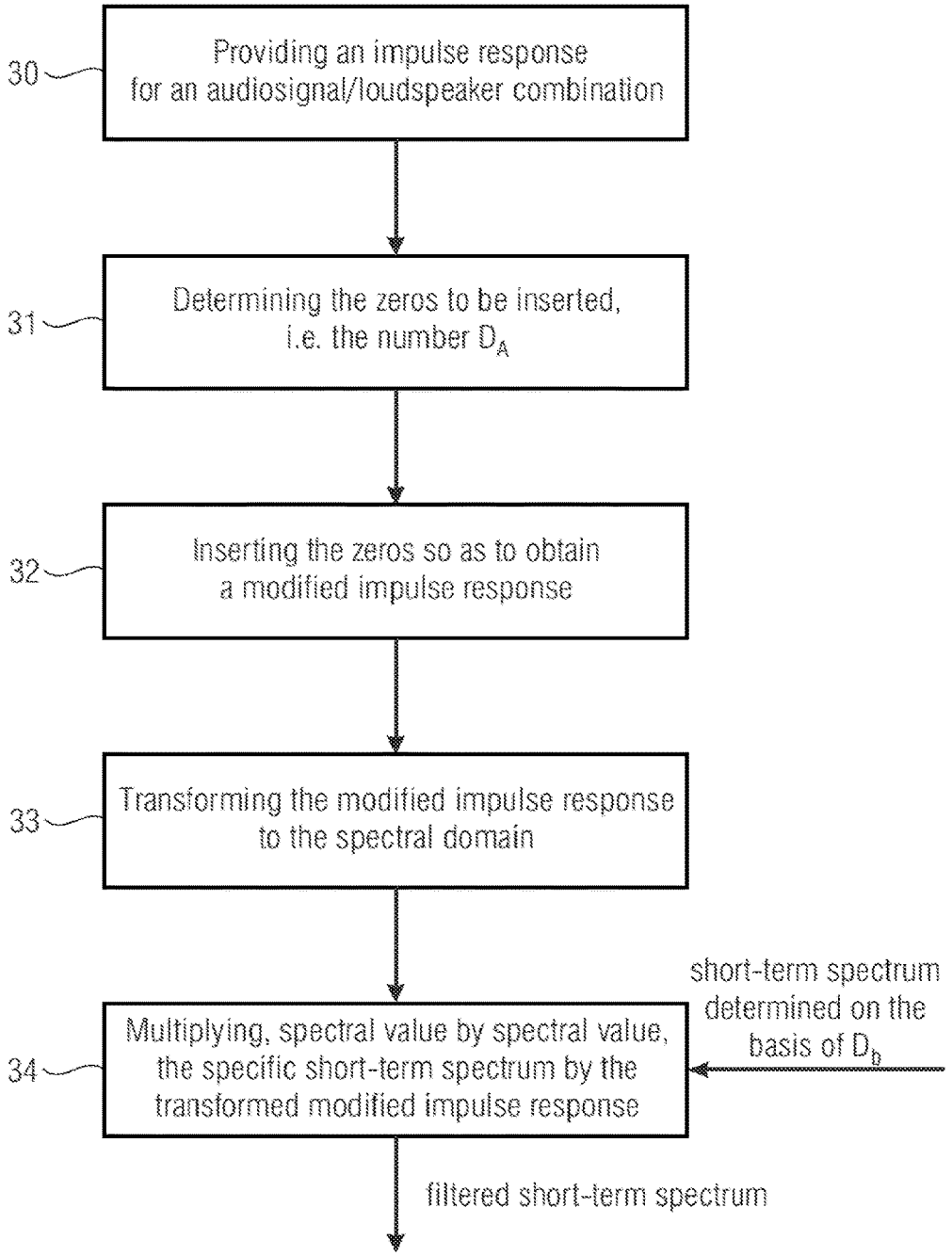
FIG. 1*c* shows a representation of an advantageous implementation of the filter stage so as to obtain a filtered short-term spectrum when a new delay value is to be set.

Subsequently, an advantageous implementation of the filter stage 300 will be discussed while referring to FIG. 1*c*.

In a step 30, an impulse response for an audio signal/loudspeaker combination is provided. For directional sound sources, in particular, one will have a dedicated impulse response for each combination of audio signal and loudspeaker. However, for other sources, too, there are different impulse responses at least for specific combinations of audio signal and loudspeaker. In a step 31, the number of zeros to be inserted, i.e. the value $D_A$, is determined, as was depicted in FIG. 1*b* by means of step 23. Subsequently, a number of zeros equaling $D_A$ is inserted, in a step 32, into the impulse response at the beginning thereof so as to obtain a modified impulse response. Please refer to FIG. 8*a* in this context. FIG. 8*a* shows an example of an impulse response h(t), which, however, is too short as compared to a real application and which has a first value at the sample 3. Thus, one can look at the time period between the value t=0 to t=3 as the delay taken by a sound travelling from a source to a recording position, such as a microphone or a listener. This is followed by diverse samples of the impulse response, which have distances $T_A$, i.e. the sampling time duration which equals the inverse of the sampling frequency. FIG. 8*b* shows an impulse response, specifically the same impulse response after insertion of $T_A$=four zeros for the audio signal/loudspeaker combination. The impulse response shown in FIG. 8*b* thus is an impulse response as is obtained in step 32. Subsequently, a transform of this modified impulse response, i.e. of the impulse response in accordance with FIG. 8*b*, to the spectral domain is performed in a step 33, as is shown in FIG. 1*c*. Subsequently, in a step 34, the specific short-term spectrum, i.e. the short-term spectrum which has been read out from the memory by means of $D_b$ and has thus been determined, is multiplied, advantageously spectral value by spectral value, by the transformed modified impulse response obtained in step 33 so as to finally obtain a filtered short-term spectrum.

In the embodiment, the forward transform stage 100 is configured to determine the sequence of short-term spectra with the stride B from a sequence of temporal samples, so that a first sample of a first block of temporal samples converted into a short-term spectrum is spaced apart from a first sample of a second subsequent block of temporal samples by a number of samples which equals the stride value. The stride value is thus defined by the respectively first sample of the new block, said stride value being present, as will be set forth by means of FIGS. 1*d* and 1*e*, both for the overlap-save method and for the overlap-add method.

In addition, in order to enable optional storage in the memory 200, a time value associated with a short-term spectrum is advantageously stored as a block index which indicates the number of stride values by which the first sample of the short-term spectrum is temporally spaced apart from a reference value. The reference value is, e.g., the index 0 of the short-term spectrum at 249 in FIG. 9.

In addition, the memory access means is advantageously configured to determine the specific short-term spectrum on the basis of the delay value and of the time value of the specific short-term spectrum in such a manner that the time value of the specific short-term spectrum equals or is larger by 1 than the integer result of a division of the time duration corresponding to the delay value by the time duration corresponding to the stride value. In one implementation, the integer result used is precisely that which is smaller than the delay that may actually be used. Alternatively, however, one might also use the integer result plus one, said value being a "rounding-up", as it were, of the delay that may actually be used. In the event of rounding-up, a slightly too large delay is achieved, which may easily suffice for applications, however. Depending on the implementation, the question whether rounding-up or rounding-down is performed may be decided as a function of the amount of the remainder. For example, if the remainder is larger than or equal to 50% of the time duration corresponding to the stride, rounding-up may be performed, i.e. the value which is larger by one may be taken. In contrast, if the remainder is smaller than 50%, "rounding-down" may be performed, i.e. the very result of the integer division may be taken. Actually, one may speak of rounding-down when the remainder is not implemented as well, e.g. by inserting zeros.

In other words, the implementation presented above and comprising rounding-up and/or rounding-down may be useful when a delay is applied which is achieved only by means of granulation of a block length, i.e. when no finer delay is achieved by inserting zeros into an impulse response. However, if a finer delay is achieved by inserting zeros into an impulse response, rounding-down rather than rounding-up will be performed in order to determine the block offset.

Figure 9:
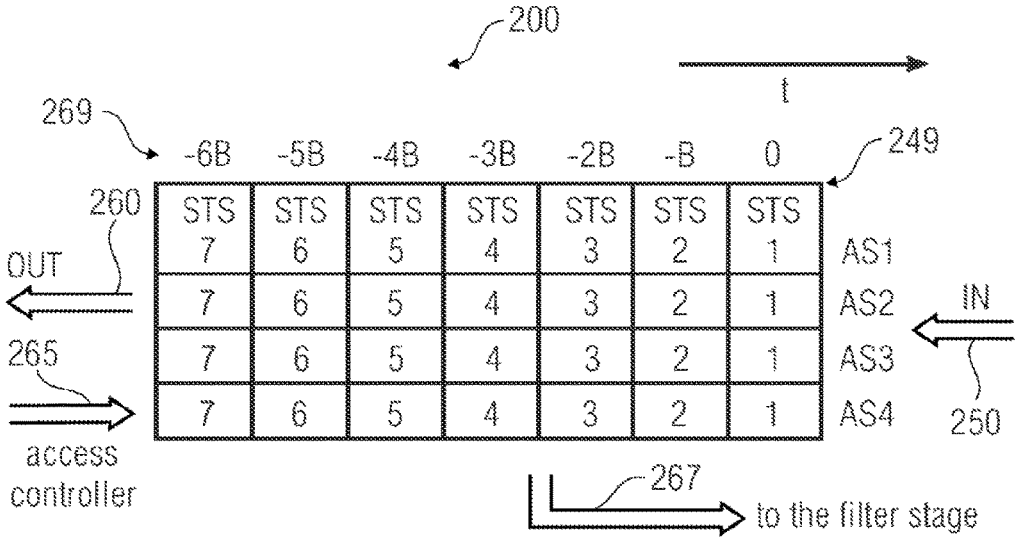
FIG. 9 shows a specific memory comprising an input interface and an output interface.

In order to explain this implementation, reference shall be made to FIG. 9. FIG. 9 shows a specific memory 300 comprising an input interface 250 and an output interface 260. Of each audio signal, i.e. of audio signal 1, of audio signal 2, of audio signal 3, and of audio signal 4, a temporal sequence of short-term spectra with, e.g., seven short-term spectra is stored in the memory. In particular, the spectra are read into the memory such that there will be seven short-term spectra in the memory, and such that the corresponding short-term spectrum "falls out" as it were, at the output 260 of the memory when the memory is filled and when a further, new short-term spectrum is fed into the memory. Said falling-out is implemented by overwriting the memory cells, for example, or by resorting the indices accordingly into the individual memory fields and is illustrated accordingly in FIG. 9 merely for illustration reasons. The access controller accesses via an access control line 265 in order to read out specific memory fields, i.e. specific short-term spectra, which are then supplied to the filter stage 300 of FIG. 1*a* via a readout output 267.

Figure 4:
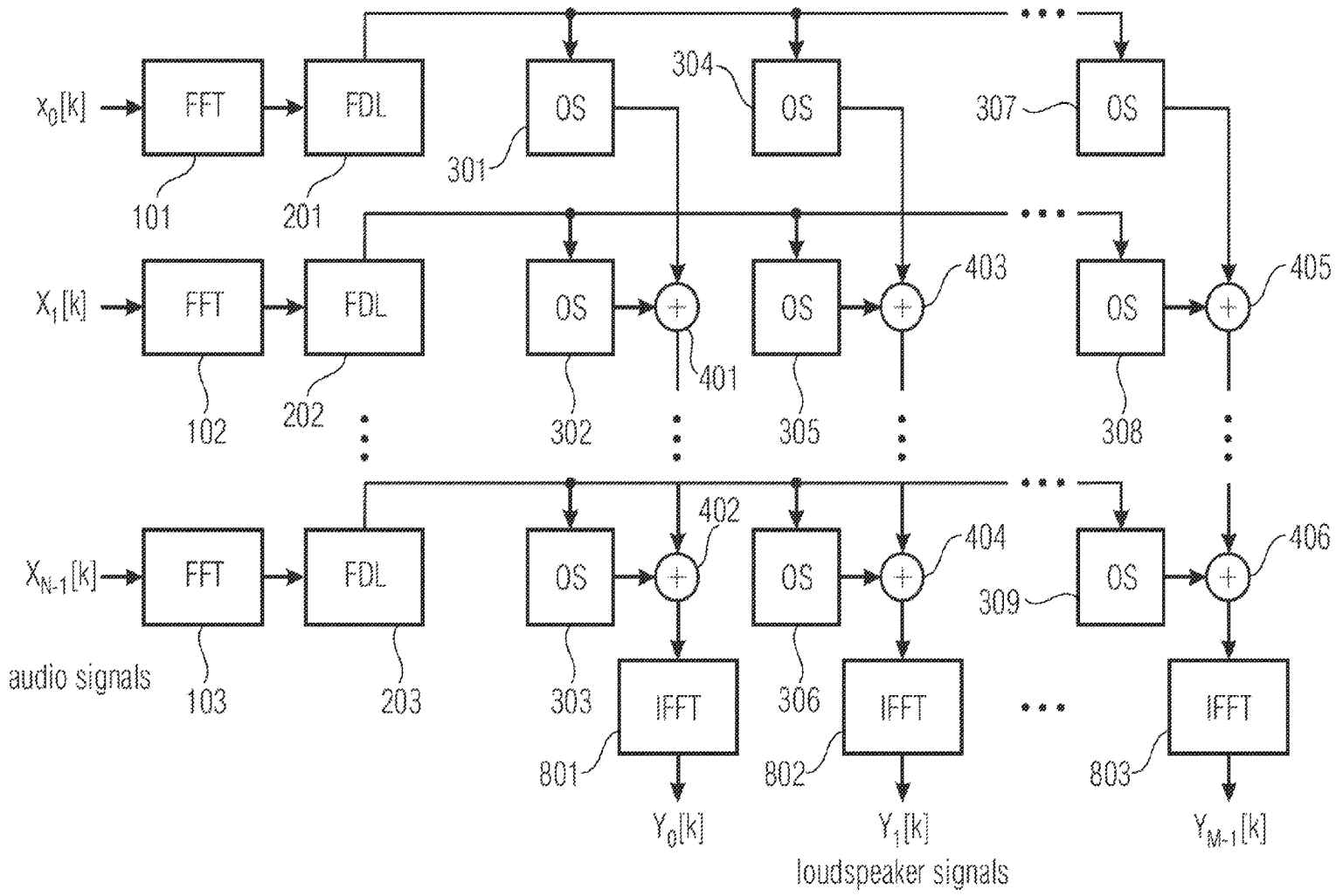
FIG. 4 shows the fundamental structure of signal processing when using a frequency-domain delay line in accordance with the invention.

A specific exemplary access controller might read out, for example for the implementation of FIG. 4 and, there, for specific OS blocks as are depicted in FIG. 9, i.e. for specific audio signal/loudspeaker combinations, corresponding short-term spectra of the audio signals using the corresponding time value, which is a multiple of B in FIG. 9 at 269. In particular, the delay value might be such that a delay of two stride lengths 2B may be used for the combination OS 301. In addition, no delay, i.e. a delay of 0, might be used for the combination OS 304, whereas for OS 302, a delay of five stride values, i.e. 5B, may be used, etc., as is depicted in FIG. 9. As far as that goes, the memory access controller 265 would read out, at a specific point in time, all of the corresponding short-term spectra in accordance with the table 270 in FIG. 9, and then provide them to the filter stage via the output 267, as will be set forth with reference to FIG. 4. In the embodiment shown in FIG. 9, the storage depth amounts to seven short-term spectra, by way of example, so that one may implement a delay which is, at the most, equal to the time duration which corresponds to six stride values B. This means that by means of the memory in FIG. 9, a value of $D_b$ of FIG. 1*b*, step 21, of a maximum of 6 may be implemented. Depending on how the delay requirements and the stride values B are set in a specific implementation, the memory may be larger or smaller and/or deeper or less deep.

In a specific implementation as was already illustrated with reference to FIG. 1*c*, the filter stage is configured to determine a modified impulse response—from an impulse response of a filter provided for the combination of loudspeaker and audio signal—by inserting a number of zeros at the temporal beginning of the impulse response, said number of zeros depending on the delay value for the combination of audio signal and loudspeaker and on the selected specific short-term spectrum for the combination of audio signal and loudspeaker. Advantageously, the filter stage is configured to insert such a number of zeros that a time duration which corresponds to the number of zeros and which may be equal to the value $D_A$ is smaller than or equal to the remainder of the integer division of the residual value $D_r$ by the sampling duration $T_A$ of FIG. 1*b*. As has also been shown with reference to FIG. 1*b* at 25, the impulse response of the filter may be an impulse response for a fractional-delay filter configured to achieve a delay in accordance with a fraction of a time duration between adjacent discrete impulse response values, said fraction equaling the delay value ($D-D_b \times B-D_A \times T_A$) of FIG. 1*b*, as may also be seen from 26 in FIG. 1*b*.

Advantageously, the memory 200 includes, for each audio source, a frequency-domain delay line, or FDL, 201, 202, 203 of FIG. 4. The FDL 201, 202, 203, which is also schematically depicted accordingly in FIG. 9, enables optional access to the short-term spectra stored for the corresponding source and/or for the corresponding audio signal, it being possible to perform an access operation for each short-term spectrum via a time value, or index, 269.

As is shown in FIG. 4, the forward transform stage is additionally configured with a number of transform blocks 101, 102, 103, which is equal to the number of audio signals. In addition, the backtransform stage 800 is configured with a number of transform blocks 101, 102, 103, which is equal to the number of loudspeakers. Moreover, a frequency-domain delay line 201, 202, 203 is provided for each audio source for each audio signal, the filter stage being configured such that it comprises a number of single filters 301, 302, 303, 304, 305, 306, 307, 308, 309, the number of single filters equaling the product of the number of audio sources and the number of loudspeakers. In other words, this means that a dedicated single filter, which for simplicity's sake is designated by OS in FIG. 4, exists for each audio signal/loudspeaker combination.

Figure 1D:
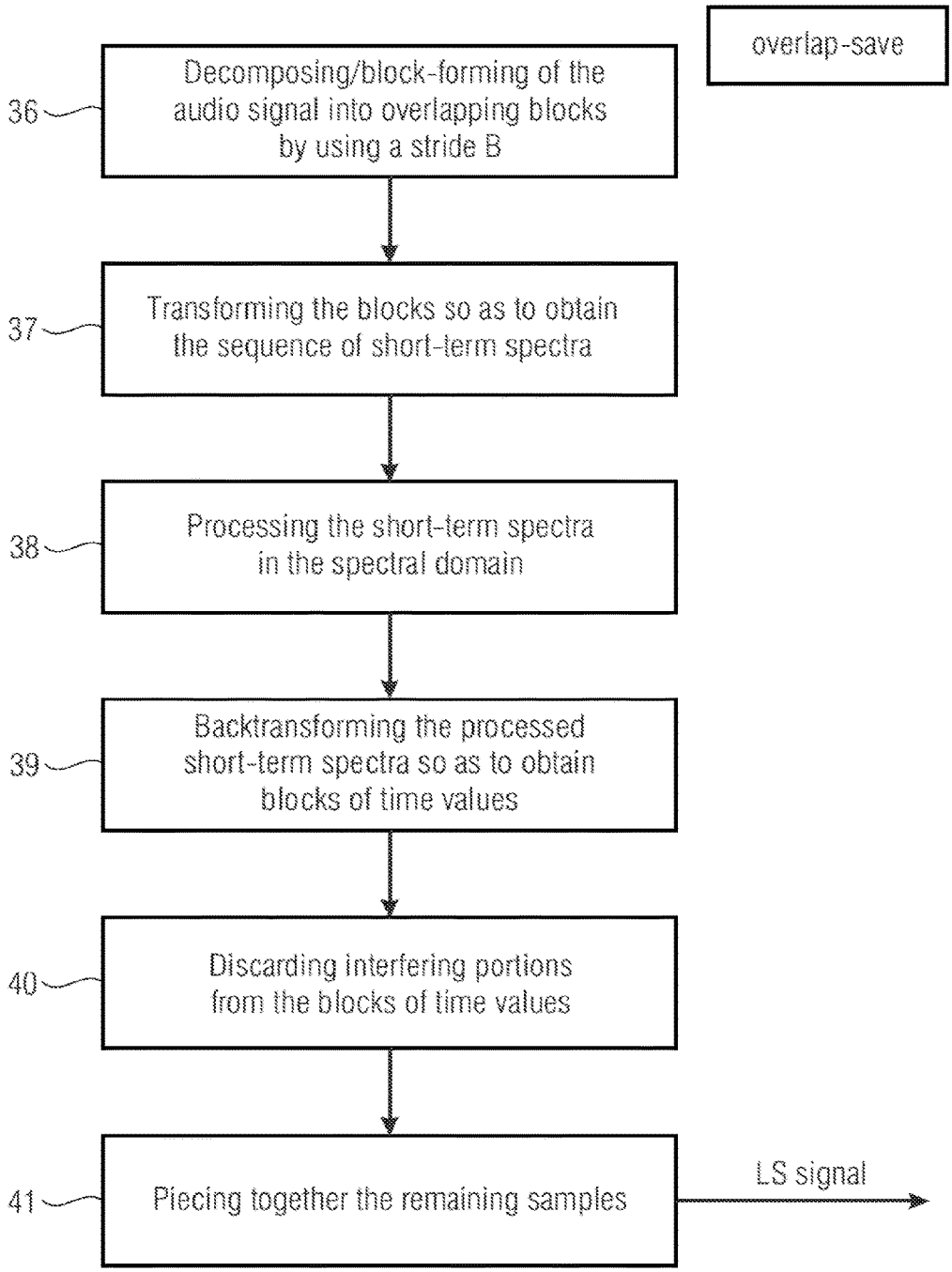
FIG. 1*d* shows an overview of the overlap-save method in the context of the present invention.
Figure 1E:
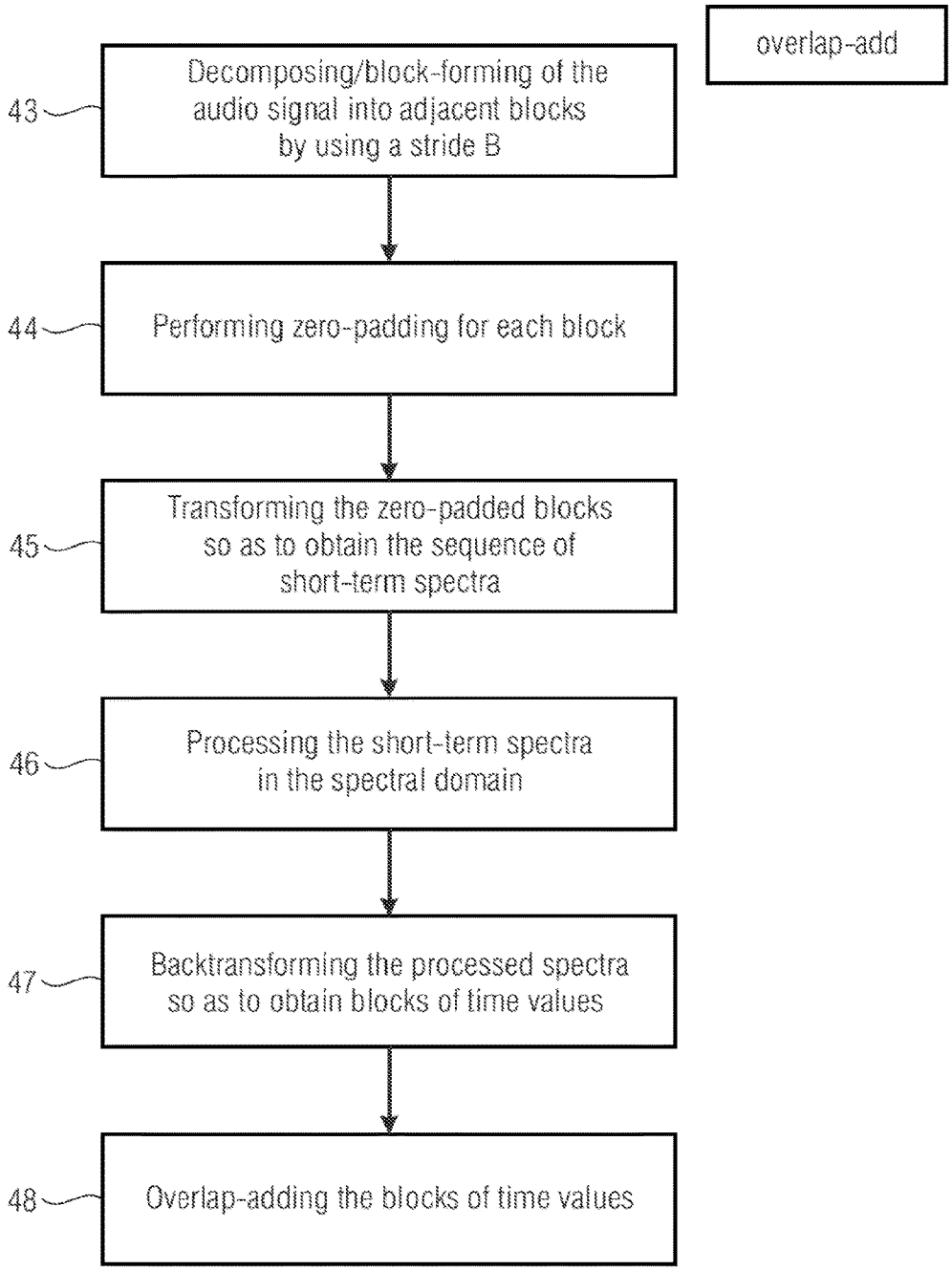
FIG. 1*e* shows an overview of the overlap-add method in the context of the present invention.

In an advantageous embodiment, the forward transform stage 100 and the backtransform stage 800 are configured in accordance with an overlap-save method, which will be explained below by means of FIG. 1*d*. The overlap-save method is a method of fast convolution. Unlike the overlap-add method, which is set forth in FIG. 1*e*, the input sequence here is decomposed into mutually overlapping subsequences, as is depicted at 36 in FIG. 1*d*. Following this, those portions which match the aperiodic, fast convolution are withdrawn from the periodic convolution products (cyclic convolution) that have formed. The overlap-save method may also be employed for efficiently implementing higher-order FIR filters. The blocks formed in step 36 are then transformed in each case in the forward transform stage 100 of FIG. 1*a*, as is depicted at 37, so as to obtain the sequence of short-term spectra. Subsequently, the short-term spectra are processed in the spectral domain by the entire functionality of the present invention, as is depicted in summary at 38. In addition, the processed short-term spectra are transformed back in a block 800, i.e. the backtransform block, as is depicted in 39, so as to obtain blocks of time values. The output signal, which is formed by convoluting two finite signals, may generally be split up into three parts—transient behavior, stationary behavior and decay behavior. With the overlap-save method, the input signal is decomposed into segments, and each segment is individually convoluted by means of cyclic convolution with a filter. Subsequently, the partial convolutions are re-assembled; the decay range of each of said partial convolutions now overlaps the subsequent convolution result and would therefore interfere with it. Therefore, said decay range, which leads to an incorrect result, is discarded within the framework of the method. Thus, the individual stationary parts of the individual convolutions now directly abut each other and therefore provide the correct result of the convolution. Generally, a step 40 comprises discarding interfering portions from the blocks of time values obtained after block 39, and a step 41 comprises piecing together the remaining samples in the correct temporal order so as to finally obtain the corresponding loudspeaker signals.

Alternatively, both the forward transform stage 100 and the backtransform stage 800 may be configured to perform an overlap-add method. The overlap-add method, which is also referred to as segmented convolution, is also a method of fast convolution and is controlled such that an input sequence is decomposed into actually adjacent blocks of samples with a stride B, as is depicted at 43. However, due to the attachment of zeros (also referred to as zero padding) for each block, as is shown at 44, said blocks become consecutive overlapping blocks. The input signal is thus split up into portions of the length B, which are then extended by the zero padding in accordance with step 44, so as to achieve a longer length for the result of the convolution operation. Subsequently, the blocks produced by step 44 and padded with zeros are transformed by the forward transform stage 100 in a step 45 so as to obtain the sequence of short-term spectra. Subsequently, in accordance with the processing performed in block 39 of FIG. 1*d*, the short-term spectra are processed in the spectral domain in a step 46 so as to then perform a backtransform of the processed spectra in a step 47 in order to obtain blocks of time values. Subsequently, step 48 comprises overlap-adding of the blocks of time values so as to obtain a correct result. The results of the individual convolutions are thus added up where the individual convolution products overlap, and the result of the operation corresponds to the convolution of an input sequence of a theoretically infinite length. Contrary to the overlap-save method, where "piecing together", as it were, is performed in step 41, the overlap-add method comprises performing overlap-adding of the blocks of time values in step 48 of FIG. 1*e*.

Depending on the implementation, the forward transform stage 100 and the backtransform stage 800 are configured as individual FFT blocks as shown in FIG. 4, or IFFT blocks as also shown in FIG. 4. Generally, a DFT algorithm, i.e. an algorithm for discrete Fourier transform which may deviate from the FFT algorithm, is advantageous. Moreover, other frequency domain transform methods, e.g. discrete sinus transform (DST) methods, discrete cosine transform (DCT) methods, modified discrete cosine transform (MDCT) methods or similar methods may also be employed, provided that they are suitable for the application in question.

As was already depicted by means of FIG. 1*a*, the inventive device is advantageously employed for a wave field synthesis system, so that a wave field synthesis operator 700 exists which is configured to calculate, for each combination of loudspeaker or audio source and while using a virtual position of the audio source and the position of the loudspeaker, the delay value on the basis of which the memory access controller 600 and the filter stage 300 may then operate.

There are several approaches to producing directional sound sources, or sound sources having directional characteristics, while using wave field synthesis. In addition to experimental results, most approaches are based on expanding or developing the sound field to form circular or spherical harmonics. The approach presented here also uses an expansion of the sound field of the virtual source to form circular harmonics so as to obtain a driving function for the secondary sources. This driving function will also be referred to as a WFS operator below.

Figure 7:
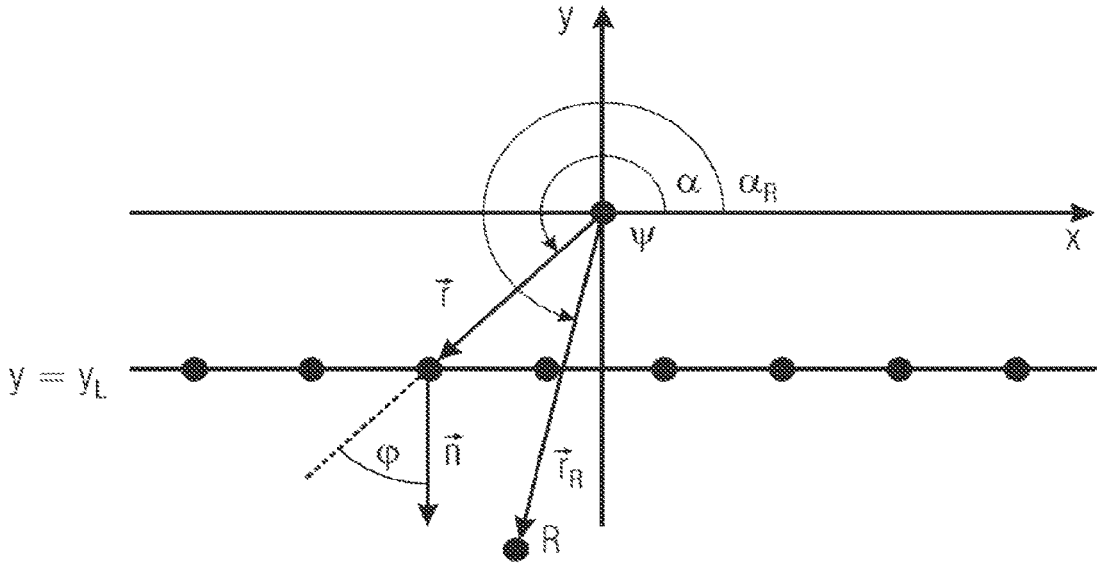
FIG. 7 shows the geometry of the designations used in this document.

FIG. 7 shows the geometry of the designations used in the general equations of wave field synthesis, i.e. in the wave field synthesis operator. In summary, for directional sources, the WFS operator is frequency-dependent, i.e. it has a dedicated amplitude and phase for each frequency, corresponding to a frequency-dependent delay. For rendering any signals, this frequency-dependent operation involves filtering of the time domain signal. This filtering operation may be implemented as FIR filtering, the FIR coefficients being determined from the frequency-dependent WFS operator by suitable design methods. The FIR filter further contains a delay, the main part of the delay being determined from the signal traveling time between the virtual source and the loudspeaker and therefore being frequency-independent, i.e. constant. Advantageously, said frequency-dependent delay is processed by means of the procedures described in combination with FIGS. 1*a* to 1*e*. However, the present invention may also be applied to alternative implementations wherein the sources are not directional or wherein there are only frequency-independent delays, or wherein, generally, fast convolution is to be used along with a delay between specific audio signal/loudspeaker combinations.

The following representation is an exemplary description of the wave field synthesis process. Alternative descriptions and implementations are also known. The sound field of the primary source ψ is generated in the region $y<y_L$ by using a linear distribution of secondary monopole sources along x (black dots).

Using the geometry of FIG. 7, the two-dimensional Rayleigh I integral is indicated in the frequency domain by $$P_R(\vec{r}_R, \vec{r}, \omega) = \frac{1}{2\pi}\int_{-\infty}^{\infty} j\omega\rho v_{\vec{n}}(\vec{r}, \omega) \; x\left(-j\pi H_0^{(2)}\left(\frac{\omega}{c}\right)|\vec{r}_R - \vec{r}|\right)dx \tag{1}$$

It states that the sound pressure $P_R(\vec{r}_R, \vec{r}, \omega)$ of a primary sound source may be generated at the receiver position R while using a linear distribution of secondary monopole line sound sources with $y=y_L$. To this end, the speed $V_{\vec{n}}(\vec{r}, \omega)$ of the primary source ψ at the positions of the secondary sources may be known in accordance with its normal $\vec{n}$. In equation (1), ω is the angular frequency, c is the speed of sound, and $$H_0^{(2)}\left(\frac{\omega}{c}|\vec{r}_R - \vec{r}|\right)$$

is the Hankel function of the second kind of the order of 0. The path from the primary source position to the secondary source position is designated by $\vec{r}$. By analogy, $\vec{r}_R$ is the path from the secondary source to the receiver R. The two-dimensional sound field emitted by a primary source ψ with any directional characteristic desired may be described by an expansion to form circular harmonics.

$$P_\psi(\vec{r}, \omega) = S(\omega)\sum_{Y=\infty}^{\infty} \breve{C}_m^{(2)}(\omega) H_v^{(2)}\frac{\omega}{c}|\vec{r}|e^{jva}, \tag{2}$$

wherein S(ω) is the spectrum of the source, and α is the azimuth angle of the vector $\vec{r}$. $\breve{C}_v^{(2)}$ (w) are the circular-harmonics expansion coefficients of the order of magnitude of v. While using the motion equation, the WFS secondary source driving function Q ( . . . ) is indicated as $$-j\omega\rho v_{\vec{n}} = \frac{\partial P_\psi(\vec{r}, \omega)}{\partial \vec{n}} \equiv Q(\ldots). \tag{3}$$

In order to obtain synthesis operators that can be realized, two assumptions are made: first of all, real loudspeakers behave rather like point sources if the size of the loudspeaker is small as compared to the emitted wavelength. Therefore, the secondary source driving function should use secondary point sources rather than line sources. Secondly, what is contemplated here is only the efficient processing of the WFS driving function. While calculation of the Hankel function involves a relatively large amount of effort, the near-field directional behavior is of relatively little importance from a practical point of view.

As a result, only the far-field approximation of the Hankel function is applied to the secondary and primary source descriptions (1) and (2). This results in the secondary source driving function $$Q(\vec{r}_R, \vec{r}, \omega, \alpha) = j\frac{\sqrt{|\vec{r}_R - \vec{r}|}}{\pi}\cos\varphi\frac{e^{-j\frac{\omega}{c}|\vec{r}|}}{\sqrt{|\vec{r}|}}S(\omega)\,x\underbrace{\sum_{Y=-\infty}^{\infty}\breve{C}_v^{(2)}(\omega)j^v e^{jva}}_{G(\omega,\alpha)} \tag{4}$$

Consequently, the synthesis integral may be expressed as $$P_R(\vec{r}_R, \vec{r}, \omega) = \int_{-\infty}^{\infty} Q(\vec{r}_R, \vec{r}, \omega, \alpha)\frac{e^{-j\frac{\omega}{c}|\vec{r}|}}{\vec{r}}dx \tag{5}$$

For a virtual source having ideal monopole characteristics, the directivity term of the source driving function becomes simpler and results in G(ω,α)=1. In this case, only a gain $$A_M(\vec{r}_R, \vec{r}) = \frac{1}{\pi}\sqrt{\frac{|\vec{r}_R - \vec{r}|}{|\vec{r}|}}\cos\varphi, \tag{6}$$

a delay term $$D(\vec{r}, \omega) = e^{-j\frac{\omega}{c}|\vec{r}|} \tag{7}$$

corresponding to a frequency-independent time delay of $$\frac{|\vec{r}|}{c},$$

and a constant phase shift of j are applied to the secondary source signal.

In addition to the synthesis of monopole sources, a common WFS system enables reproduction of planar wave fronts, which are referred to as plane waves. These may be considered as monopole sources arranged at an infinite distance. As in the case of monopole sources, the resulting synthesis operator consists of a static filter, a gain factor, and a time delay.

For complex directional characteristics, the gain factor A( . . . ) becomes dependent on the directional characteristic, the alignment and the frequency of the virtual source as well as on the positions of the virtual and secondary sources. Consequently, the synthesis operator contains a non-trivial filter, specifically for each secondary source $$A_D(\vec{r}_R, \vec{r}, \omega, \alpha) = \frac{j}{\pi}\sqrt{\frac{|\vec{r}_R - \vec{r}|}{|\vec{r}|}}\cos\varphi G(\omega, \alpha) \tag{8}$$

As in the case of fundamental types of sources, the delay may be extracted from (4) from the propagation time between the virtual and secondary sources $$D(\vec{r}, \omega) = e^{-j\frac{\omega}{c}|\vec{r}|}. \tag{9}$$

For practical rendering, time-discrete filters for the directional characteristics are determined by the frequency response (8). Because of their ability to approximate any frequency responses and their inherent stability, only FIR filters will be considered here. These directivity filters will be referred to as $h_{m,n}[k]$ below, wherein n=0, . . . , M−1 designates the virtual-source index, n=0, . . . , M−1 is the loudspeaker index, and k is a time domain index. K is the order of magnitude of the directivity filter. Since such filters are needed for each combination of N virtual sources and M loudspeakers, production is expected to be relatively efficient.

Here, a simple window (or frequency sampling design) is used. The desired frequency response (9) is evaluated at K+1 equidistantly sampled frequency values within the interval $0 \leq \omega 2\pi$. The discrete filter coefficients $h_{m,n}[k]$, k=0, . . . , K are obtained by an inverse discrete Fourier transform (IDFT) and by applying a suitable window function w[k] so as to reduce the Gibbs phenomenon caused by cutting off of the impulse response.

$$h_{m,n}[k] = w[k]\mathrm{IDFT}\{A_D(\vec{r}_R, \vec{r}, \omega, \alpha)\} \tag{10}$$

Implementing this design method enables several optimizations. First of all, the conjugated symmetry of the frequency response $A_D(\vec{r}_R, \vec{r}, \omega, \alpha)$; this function is evaluated only for approximately half of the raster points. Secondly, several parts of the secondary source driving function, e.g. the expansion coefficients $\check{C}_\nu^{(2)}(\omega)$, are identical for all of the driving functions of any given virtual source and, therefore, are calculated only once. The directivity filters $h_{m,n}[k]$ introduce synthesis errors in two ways. On the one hand, the limited order of magnitude of filters results in an incomplete approximation of $A_D(\vec{r}_R, \vec{r}, \omega, \alpha)$. On the other hand, the infinite summation of (4) is replaced by a finite boundary. As a result, the beam width of the generated directional characteristics cannot become infinitely narrow.

Figure 2:
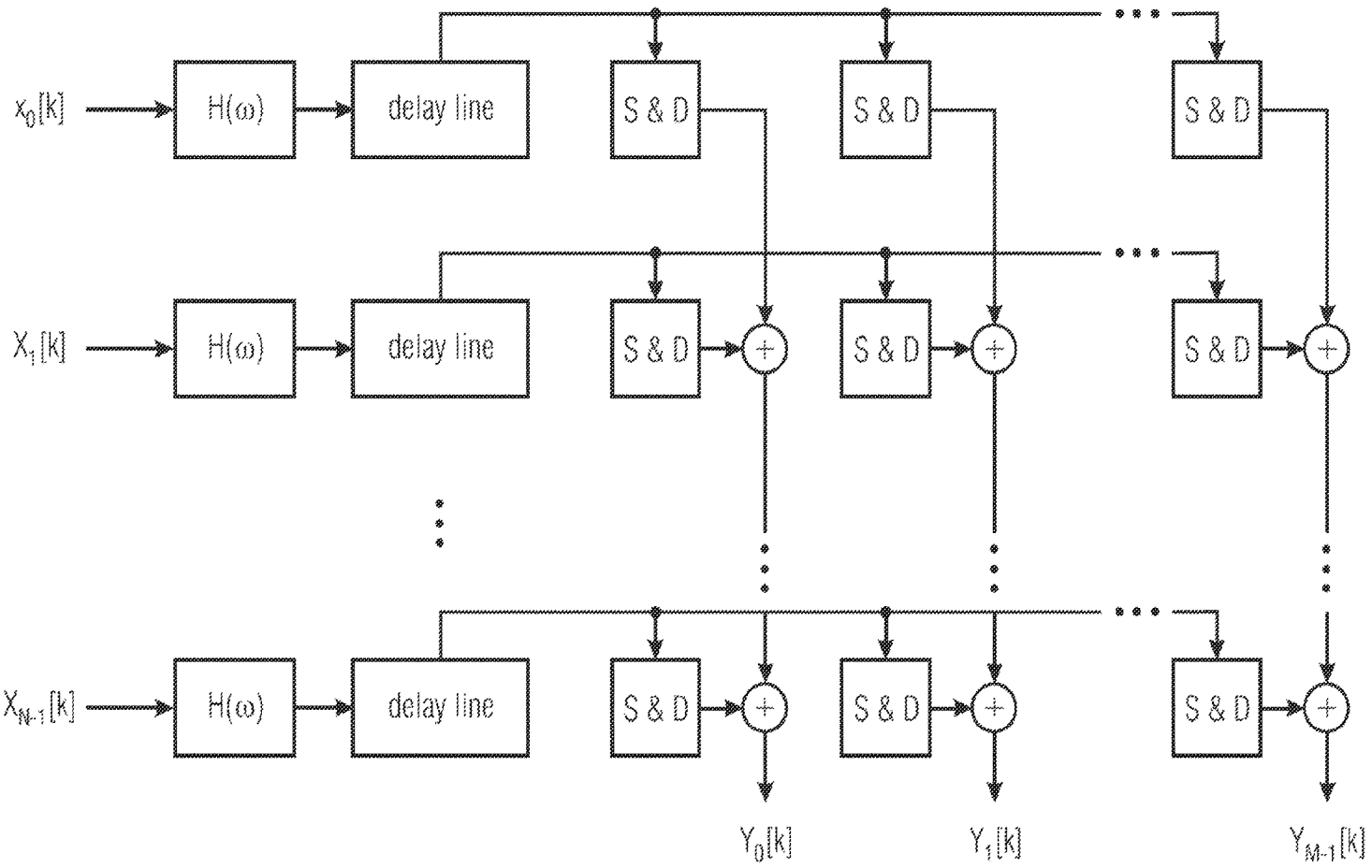
FIG. 2 shows the fundamental structure of signal processing when using a WFS rendering system without any frequency-dependent filtering by means of delay and amplitude scaling (scale & delay) in the time domain.

FIG. 2 shows the fundamental structure of signal processing when a simple WFS operator is used which is based on a scale & delay operation. What is shown is the signal processing structure of WFS rendering systems for the synthesis of fundamental types of primary sources. The secondary source driving signals may be determined by processing a scaling operation and a delay operation for each combination of primary source and secondary source (S&D=scale and delay) and by processing a static input filter H(ω).

WFS processing is generally implemented as a time-discrete processing system. It consists of two general tasks: calculating the synthesis operator and applying this operator to the time-discrete source signals. The latter will be referred to WFS rendering in the following.

The impact of the synthesis operator on the overall complexity is typically low since said synthesis operator is calculated relatively rarely. If the source properties change in a discrete manner only, the operator will be calculated as needed. For continuously changing source properties, e.g. in the case of moving sound sources, it is typically sufficient to calculate said values on a coarse grid and to use simple interpolation methods in between.

In contrast to this, application of the synthesis operator to the source signals is performed at the full audio sampling rate. FIG. 2 shows the structure of a typical WFS rendering system with N virtual sources and M loudspeakers. As was illustrated in section 2.2, the secondary source driving function consists of a fixed pre-filter H(ω)=j and of applying a time delay $D(\vec{r}, \omega)$ and a scaling factor $A_M(\vec{r}_R, \vec{r})$. Since H(ω) is independent of the positions of the source and of the loudspeaker, it is applied to the input signals prior to being stored in a time-domain delay line. While using this delay line, a component signal is calculated for each combination of a virtual source and a loudspeaker, which is represented by a scale and delay operation (S&D). In the simplest case, the delay value is rounded down to the closest integer multiple of the sampling period and is applied as an indexed access to the delay line. In the case of moving source objects, more complex algorithms are needed in order to interpolate the source signal at random positions between samples. Finally, the component signals are accumulated for each loudspeaker in order to form the driving signals.

The number of scale and delay operations is formed by the product of the number of virtual sources N and the number of loudspeakers M. Thus, this product typically reaches high values. Consequently, the scale and delay operation is the most critical part, in terms of performance, of most WFS systems—even if only integer delays are used.

Figure 3:
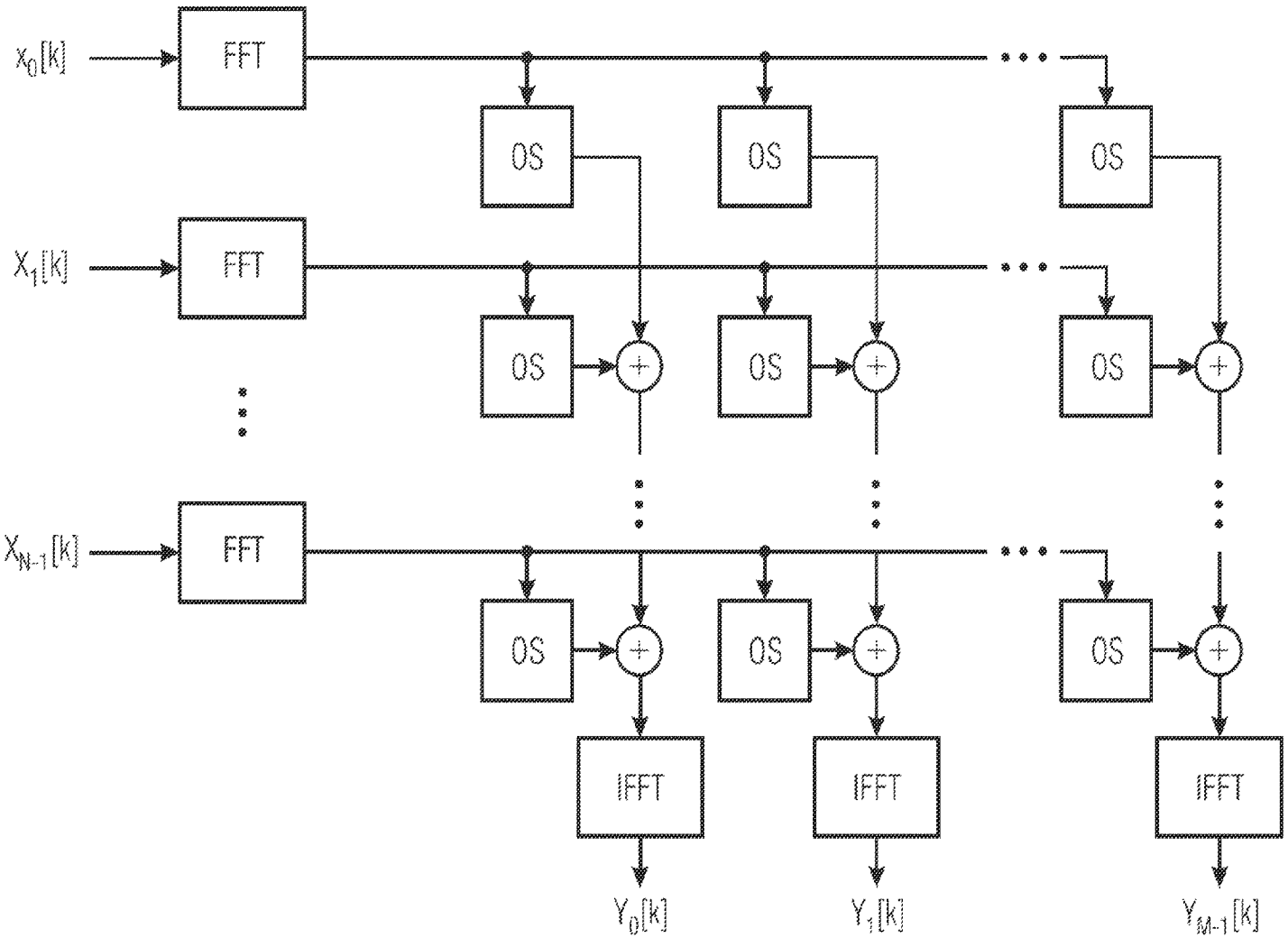
FIG. 3 shows the fundamental structure of signal processing when using the overlap & save technique.

FIG. 3 shows the fundamental structure of signal processing when using the overlap & save technique. The overlap-save method is a method of fast convolution. In contrast to the overlap-add method, the input sequence x[n] here is decomposed into mutually overlapping subsequences. Following this, those portions which match the aperiodic, fast convolution are withdrawn from the periodic convolution products (cyclic convolution) that have formed.

By means of FIG. 2, an explanation was given that the scale and delay operation applied to each combination of a virtual source and a loudspeaker is highly performance-critical for conventional WFS rendering systems. For sound sources having a directional characteristic, an additional filtering operation, typically implemented as an FIR filter, may be used for each such combination. While taking into account the computational expenditure of FIR filters, the resulting complexity will no longer be economically feasible for most real WFS rendering systems.

In order to substantially reduce the computing resources that may be used, the invention proposes a signal processing scheme based on two interacting effects.

The first effect relates to the fact that the efficiency of FIR filters may frequently be increased by using fast convolution methods in the transform domain, such as overlap-save or overlap-add, for example. Generally, said algorithms transform segments of the input signal to the frequency domain by means of fast Fourier transform (FFT) techniques, perform a convolution by means of frequency domain multiplication, and transform the signal back to the time domain. Even though the actual performance highly depends on the hardware, the order of magnitude of the filter typically ranges between 16 and 50 where transform-based filtering becomes more efficient than direct convolution. For overlap-add algorithms and overlap-save algorithms, the forward and inverse FFT operations constitute the large part of the computational expenditure.

Advantageously, it is only the overlap-save method that is taken into account since it involves no addition of components of adjacent output blocks. In addition to the reduced arithmetic complexity as compared to overlap-add, said property results in a simpler control logic for the proposed processing scheme.

A further embodiment for reducing the computational expenditure exploits the structure of the WFS processing scheme. On the one hand, here each input signal is used for a large number of delay and filtering operations. On the other hand, the results for a large number of sound sources are summed for each loudspeaker. Thus, partitioning of the signal processing algorithm, which performs typical operations only once for each input or output signal, promises gains in efficiency. Generally, such partitioning of the WFS rendering algorithm results in considerable improvements in performance for moving sound sources of fundamental types of sources.

When transform-based fast convolution is employed for rendering directional sound sources, or sound sources having directional characteristics, the forward and inverse Fourier transform operations are obvious candidates for said partitioning. The resulting processing scheme is shown in FIG. 3. The input signals $x_n[k]$, n=0, . . . , N−1 are segmented into blocks and are transformed to the frequency domain while using fast Fourier transforms (FFT). The frequency domain representation is used several times for convoluting the individual loudspeaker signal components by means of an overlap-save operation, i.e. a complex multiplication. The loudspeaker signals are calculated, in the frequency domain, by accumulating the component signals of all sources. Finally, performing a fast inverse Fourier transform (IFFT) of these blocks and a concatenation in accordance with the overlap-save scheme yields the loudspeaker driving signals $y_m[k]$, m=0, . . . , M−1 in the time domain. In this manner, those parts of the transform domain convolution which are most critical in terms of performance, namely the FFT and IFFT operations, are performed only once for each source, or each loudspeaker.

FIG. 4 shows the fundamental structure of signal processing when using a frequency-domain delay line in accordance with the invention. What is shown is a block-based transform domain WFS signal processing scheme. OS stands for overlap-save, and FDL stands for frequency-domain delay line.

FIG. 4 shows a specific implementation of the embodiment of FIG. 1*a*, which comprises a matrix-shaped structure, the forward transform stage 100 comprising individual FFT blocks 101, 102, 103. In addition, the memory 200 includes different frequency-domain delay lines 201, 202, 203 which are driven via the memory access controller 600, not shown in FIG. 4, so as to determine the correct short-term spectrum for each filter stage 301-309 and to perform said correct short-term spectrum to the corresponding filter stage at a specific point in time, as is set forth by means of FIG. 9. In addition, the summing stage 400 includes schematically drawn summators 401-406, and the backtransform stage 800 includes individual IFFT blocks 801, 802, 803 so as to finally obtain the loudspeaker signals. Advantageously, both the blocks 101-103 and the blocks 801-803 are configured to perform the processing steps, which may be used by methods of fast convolution such as the overlap-save method or the overlap-add method, for example, prior to the actual transform or following the actual backtransform.

As was explained by means of FIG. 7, the WFS operator determines an individual delay for each source/loudspeaker combination. Even though the proposed signal processing scheme enables efficient multichannel convolution, application of said delays involves detailed consideration. With the conventional time domain algorithm, integer-valued sample delays may be implemented by accessing a time-domain delay line with little impact on the overall complexity. In the frequency domain, a time delay cannot be implemented in the same manner.

Conceptually, a random time delay may readily be built into the FIR directivity filter. Due to the large range of the delay value in a typical WFS system, however, this approach results in very long filter lengths and, thus, in large FFT block sizes. On the one hand, this considerably increases the computational expenditure and the storage requirements. On the other hand, the latency period for forming input blocks is not acceptable for many applications due to the block formation delay that may be used for such large FFT sizes.

For this reason, a processing scheme is proposed here which is based on a frequency-domain delay line and on partitioning of the delay value. Similarly to the conventional overlap-save method, the input signal is segmented into overlapping blocks of the size L and into a stride (or delay block size) B between adjacent blocks. The blocks are transformed to the frequency domain and are designated by Xn[I], wherein n designates the source, and I is the block index. These blocks are stored in a structure which enables indexed access of the form Xn[I-i] to the most recent frequency domain blocks. Conceptually, this data structure is identical with the frequency-domain delay lines used within the context of partitioned convolution.

The delay value D, indicated in samples, is partitioned into a multiple of the block delay quantity and into a remainder $D_r$ or $D_r'$ $$D=D_bB+D_r \text{ with } 0\leq D_r\leq B-1, D_b\in \mathbb{N}. \tag{11}$$

The block delay $D_b$ is applied as an indexed access to the frequency-domain delay line. By contrast, the remaining part is included into the directivity filter $h_{m,n}[k]$, which is formally expressed by a convolution with the delay operator $\delta(k-D_r)$ $$h_{m,n}^{d}[k]=h_{m,n}[k]*\delta(k-D_r). \tag{12}$$

For integer delay values, this operation corresponds to preceding $h_{m,n}[k]$ with $D_r$ zeros. The resulting filter is padded with zeros in accordance with the requirements of the overlap-save operation. Subsequently, the frequency-domain filter representation $H_{m,n}^{d}$ is obtained by means of an FFT.

The frequency-domain representation of the signal component from the source n to the loudspeaker m is calculated as $$C_{m,n}[l]=h_{m,n}^{d}\cdot X_n[l-D_b] \tag{13}$$

wherein · designates an element-by-element complex multiplication. The frequency-domain representation of the driving signal for the loudspeaker m is determined by accumulating the corresponding component signals, which is implemented as a complex-valued vector addition $$Y_m[l] = N-1\sum_{n=0}^{N-1} C_{m,n}[l]. \tag{14}$$

The remainder of the algorithm is identical with the ordinary overlap-save algorithm. The blocks $Y_m[I]$ are transformed to the time domain, and the loudspeaker driving signals $y_m[k]$ are formed by deleting a predetermined number of samples from each time domain block. This signal processing structure is schematically shown in FIG. 4.

The lengths of the transformed segments and the shift between adjacent segments follow from the derivation of the conventional overlap-save algorithm. A linear convolution of a segment of the length L with a sequence of the length P, L<P, corresponds to a complex multiplication of two frequency domain vectors of the size L and yields L−P+1 output samples. Thus, the input segments are shifted by this amount, subsequently referred to as B=L−P+1. Conversely, in order to obtain B output samples from each input segment for a convolution with an FIR filter of the order of magnitude of K (length P=K−1), the transformed segments have a length of $$L=K+B. \tag{15}$$

If the integer part of the remainder portion $D_r$ of the delay is embedded into the filter $h_{m,n}^d[k]$ in accordance with (12), the order of magnitude for $h_{m,n}^d[k]$ that may be used will result in K'=K+B−1. This is due to the fact that $h_{m,n}^d[k]$ is preceded by a maximum of B−1 zeros, which is the maximum value for $D_r$ (11). Thus, the segment length that may be used for the proposed algorithm is indicated by $$L=K+2B-1. \tag{16}$$

So far, only integer sample delay values D have been taken into account. However, the proposed processing scheme may be extended to include any delay values by accommodating an FD filter (FD=fractional delay), a so-called directivity filter $h_{m,n}^d[k]$. Here, only FIR-FD filters are taken into account since they may readily be integrated into the proposed algorithm. To this end, the residual delay $D_r$ is partitioned into an integer part $D_{int}$ and a fractional delay value d, as is customary in the FD filter design. The integer part is integrated into $h_{m,n}^d[k]$ by preceding $h_{m,n}[k]$ with $D_{int}$ zeros. The fractional delay value is applied to $h_{m,n}^d[k]$ by convoluting same with an FD filter designed for this fractional value d. Thus, the order of magnitude of $h_{m,n}^d[k]$ that may be used is increased by the order of magnitude of the FD filter $K_{FD}$, and the block size L (16) that may be used changes to $$L=K+K_{FD}+2B-1. \tag{17}$$

However, the advantages of using random delay values are highly limited. It has been shown that fractional delay values may be used only for moving virtual sources. However, they have no positive effect on the quality as far as static sources are concerned. On the other hand, the synthesis of moving directional sound sources, or sound sources having directional characteristics, would entail constant temporal variation of synthesis filters, the design of which would dominate the overall complexity of rendering in a simple implementation.

Figure 5:
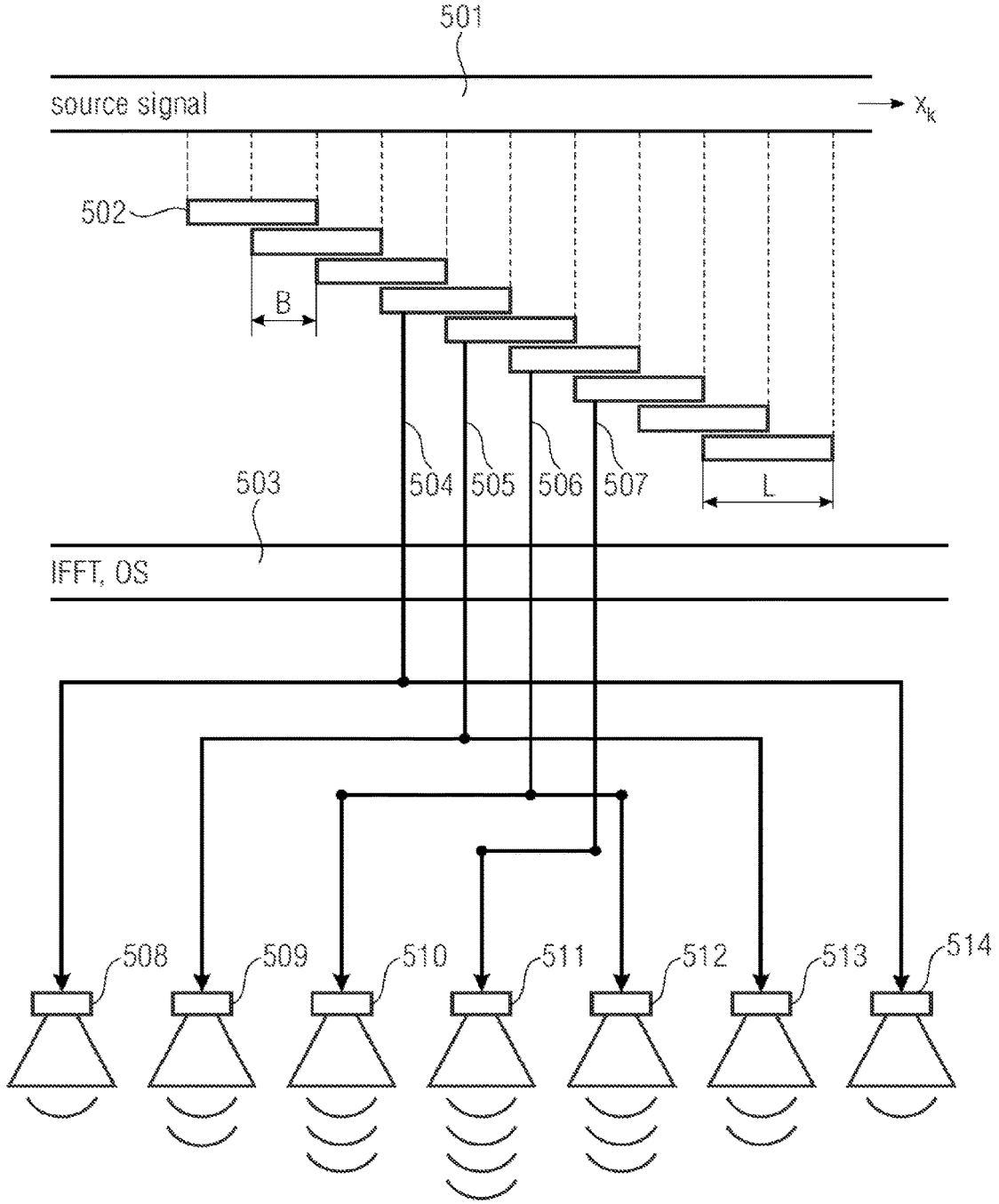
FIG. 5 shows the fundamental structure of signal processing with a frequency-domain delay line in accordance with the invention.

FIG. 5 shows the fundamental structure of signal processing with a frequency-domain delay line in accordance with the invention. The source signal $x_k$ is transformed to the spectra in mutually overlapping FFT calculating blocks 502 of the block length L, the FFT calculating blocks comprising a mutual overlap of the length (L-B) and a stride of the length B.

In a next step, fast convolution in accordance with the overlap-save method (OS) as well as a backtransform with an IFFT to the loudspeaker signals $y_0 \ldots y_{M-1}$ is performed at stage 503. What is decisive here is the manner in which access to the spectra occurs. By way of example, access operations 504, 505, 506, and 507 are depicted in the figure. In relation to the time of the access operation 507, access operations 504, 505, and 506 are in the past.

If the loudspeaker 511 is driven by means of the access operation 507 and if, simultaneously, loudspeakers 510, 512 are driven by means of the access operation 506, it seems to the listener as if the loudspeaker signals of the loudspeakers 510, 512 are delayed as compared to the loudspeaker signal of the loudspeaker 511. The same applies to the access operation 505 and the loudspeaker signals of the loudspeakers 509, 513 as well as to the access operation 504 and to the loudspeaker signals of the loudspeakers 508, 514.

In this manner, each individual loudspeaker may be driven with a delay corresponding to a multiple of the block stride B. If further delay is to be provided which is smaller than the block stride B, this may be achieved by preceding the corresponding impulse response of the filter, which is the subject of the overlap-save operation, with zeros.

FIGS. 6*a-d* show a comparative representation of the computational expenditure for different convolution algorithms. What is shown is a complexity comparison of three different directional sound sources, or sound sources having directional characteristic rendering algorithms. What is represented in each case is the number of commands for calculating a single sample for all of the loudspeaker signals. The default parameters are N=16, M=128, K=1023, B=1024. For the transform-based algorithms, the proportionality constant for the FFT complexity is set to p=3.

In order to evaluate the potential increase in efficiency achieved by the proposed processing structure, a performance comparison is provided here which is based on the number of arithmetic commands. It should be understood that this comparison can only provide rough estimations of the relative performances of the different algorithms. The actual performance may differ on the basis of the characteristics of the actual hardware architecture. Performance characteristics of, in particular, the FFT operations involved differ considerably, depending on the library used, the actual FFT sizes, and the hardware. In addition, the memory capacity of the hardware used may have a critical impact on the efficiency of the algorithms compared. For this reason, the memory requirements for the filter coefficients and the delay line structures, which are the main sources of memory consumption, are also indicated.

The main parameters determining the complexity of a rendering algorithm for directional sound sources, or sound sources having directional characteristics, are the number of virtual sources N, the number of loudspeakers M, and the filter order of the directivity filter K. For methods based on fast convolution, the shift between adjacent input blocks, which is also referred to as the block delay B, impairs performance and memory requirements. In addition, block-by-block operation of the fast convolution algorithms introduces an implementation latency period of B−1 samples. The maximally allowed delay value, which is referred to as $D_{max}$ and is indicated as a number of samples, influences the memory size that may be used for the delay line structures.

Three different algorithms are compared: linear convolution, filter-by-filter fast convolution, and the proposed processing structure. The method which is based on linear convolution performs NM time domain convolutions of the order of magnitude of K. This amounts to NM(2K+1) commands per sample. In addition, M(N−1) real additions may be used for accumulating the loudspeaker driving signals. The memory that may be used for an individual delay line is $D_{max}$+K floating-point values. Each of the MN FIR filters $h_{m,n}[k]$ may use K+1 memory words for floating-point values. These performance numbers are summarized in the following table. The table shows a performance comparison for wave field synthesis signal processing schemes for directional sound sources, or sound sources having directional characteristics. The number of commands is indicated for calculating a sample for all of the loudspeakers. The memory requirements are specified as numbers of floating-point values.

| algorithm | commands | delay line storage | filter memory |
|---|---|---|---|
| linear convolution | $M[N(2K+1)+(N-1)]$ | $N(D_{max}+K)$ | $MN(K+1)$ |
| filter-by-filter fast convolution | $M\left[N\frac{K+B}{B}(2p\ \log_2(K+B)+3)+N-1\right]$ | $N(D_{max}+K)$ | $MN(K+B)$ |
| proposed processing scheme | $\frac{K+2B-1}{B}\left[\begin{matrix}(M+N)p \\ \log_2(K+2B-1)+M(4N-1)\end{matrix}\right]$ | $N\left[\frac{D_{max}}{B}\right](K+2B-1)$ | $MN(K+2B-1)$ |

The second algorithm, referred to as filter-by-filter linear convolution, calculates the MN FIR filters separately while using the overlap-save fast convolution method. In accordance with (15), the size of the FFT blocks in order to calculate B samples per block is L=K+B. For each filter, a real-valued FFT of the size L and an inverse FFT of the same size is performed. A number of commands of $pL\log_2(L)$ is assumed for a forward or inverse FFT of the size L, wherein p is a proportionality constant which depends on the actual implementation. p may be assumed to have value between 2.5 and 3.

Since the frequency transforms of real-valued sequences are symmetrical, complex vector multiplication of the length L, which is performed in the overlap-save method, may use approximately L/2 complex multiplications. Since a single complex multiplication is implemented by 6 arithmetic commands, the effort involved in one vector multiplication amounts to 3L commands. Thus, filtering while using the overlap-save method may use $$MN\frac{K+B}{B}[2p\log_2(K+B)+3]$$

for one single output sample on all loudspeaker signals. Similarly to the direct convolution algorithm, the effort involved in accumulating the loudspeaker signals amounts to M(N−1) commands. The delay line memory is identical with the linear convolution algorithm. In contrast, the memory requirements for the filters are increased due to the zero paddings of the filters $h_{m,n}[k]$ prior to the frequency transform. It is to be noted that a frequency domain representation of a real filter of the length L may be stored in L real-valued floating-point values because of the symmetry of the transformed sequence.

For the proposed efficient processing scheme, the block size for a block delay B equals L=K+2B−1 (16). Thus, a single FFT or inverse FFT operation may use p(K+2B−1) $\log_2$(K+2B−1) commands. However, only N forward and M inverse FFT operations may be used for each audio block. The complex multiplication and addition are each performed on the frequency domain representation and may use 3(K+2B−1) and K+2B−1 commands, respectively, for each symmetrical frequency domain block of the length K+2B−1. Since each processed block yields B output samples, the overall number of commands for a sampling clock iteration amounts to $$\frac{K+2B-1}{B}[(M+N)p\log_2(K+2B-1)+M(4N-1)].$$

Since the frequency-domain delay line stores the input signals in blocks of the size L, with a shift of B, the number of memory positions that may be used for one single input signal is $$\left[\frac{D_{max}}{B}\right](K+2B-1).$$

By analogy therewith, a frequency-transformed filter may use K+2B−1 memory words.

In order to evaluate the relative performance of these algorithms, an exemplary wave field synthesis rendering system shall be assumed for 16 virtual sources, 128 loudspeaker channels, directivity filters of the order of magnitude of 1023, and a block delay of 1024. Each parameter is varied separately so as to evaluate its influence on the overall complexity.

Figure 6A:
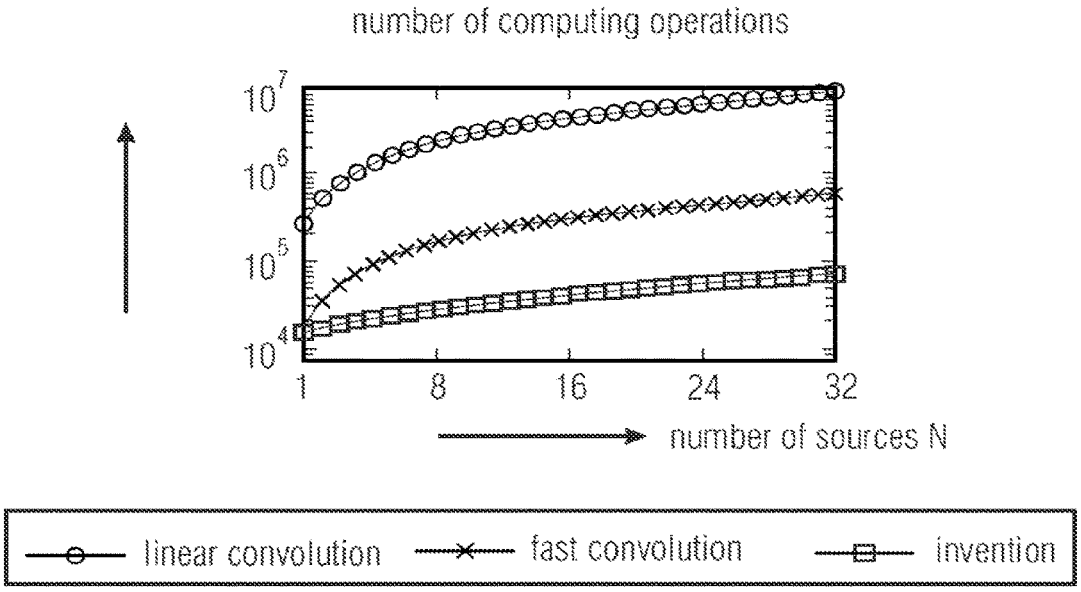
FIGS. 6*a*, 6*b*, 6*c*, and 6*d* show a comparative representation of the computing expenditure for various convolution algorithms.

FIG. 6*a* shows the complexity as a function of the number of virtual sources N. As expected, the efficiency of the filter-by-filter fast convolution algorithm exceeds that of the linear convolution algorithm by an almost constant factor. The efficiency gain of the proposed algorithm as compared to filter-by-filter fast convolution increases as N increases, whereby a relatively constant ratio is rapidly achieved. It seems remarkable that the proposed algorithm is more efficient even for one single source. However, it may use only M+N=129 transforms of the size K+2B−1 as compared to 2MN=256 for filter-by-filter fast convolution. This difference is not amortized by the larger block size and the increased multiplication and addition effort involved in the proposed algorithm.

Figure 6B:
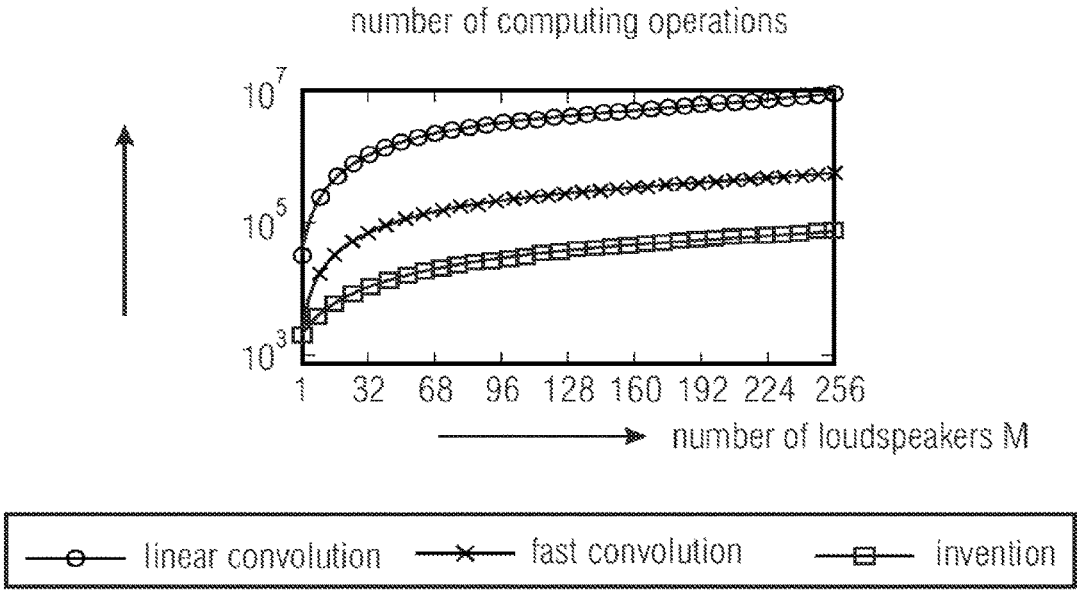

The influence of the number of loudspeaker is shown in FIG. 6*b*. As is expected from the complexity analysis, the functions are very similar to that of FIG. 6*a* in terms of quality. Thus, the proposed processing structure achieves a significant reduction in complexity even for small to medium-sized loudspeaker configurations.

Figure 6C:
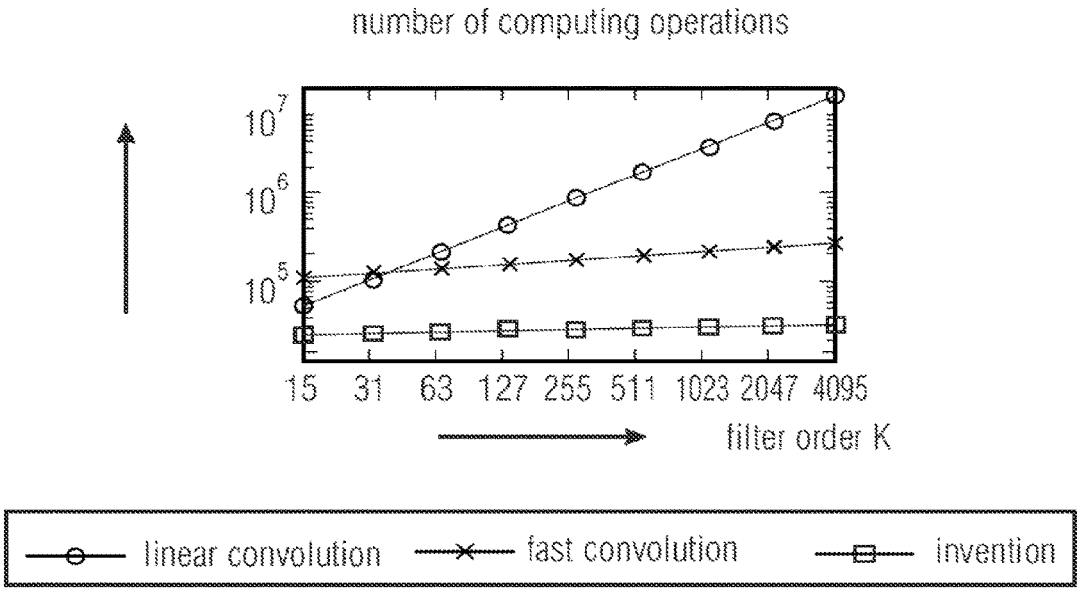

The effect of the order of magnitude of the directivity filters is examined in FIG. 6*c*. As is inherent to fast convolution algorithms, their performance improvement increases over that of linear convolution as the order of magnitude of the filters increases. It has been observed that the breakeven point, where filter-by-filter fast convolution becomes more efficient than direct convolution, ranges between 31 and 63. In contrast, the efficiency of the proposed algorithm is considerably higher, irrespective of the order of magnitude of the filters. In particular, the breakeven point, where linear convolution would become more efficient, is very much lower than for fast convolution. This is due to the fact that the number of FFT and IFFT operations, which is the main complexity in the case of filter-by-filter fast convolution, is substantially reduced by the proposed processing scheme. It is to be noted that in this experiment, the block delay quantity B is selected to be proportional to the filter length (actually B=K+1) since said choice has proven to be useful for the overlap-save algorithm.

Figure 6D:
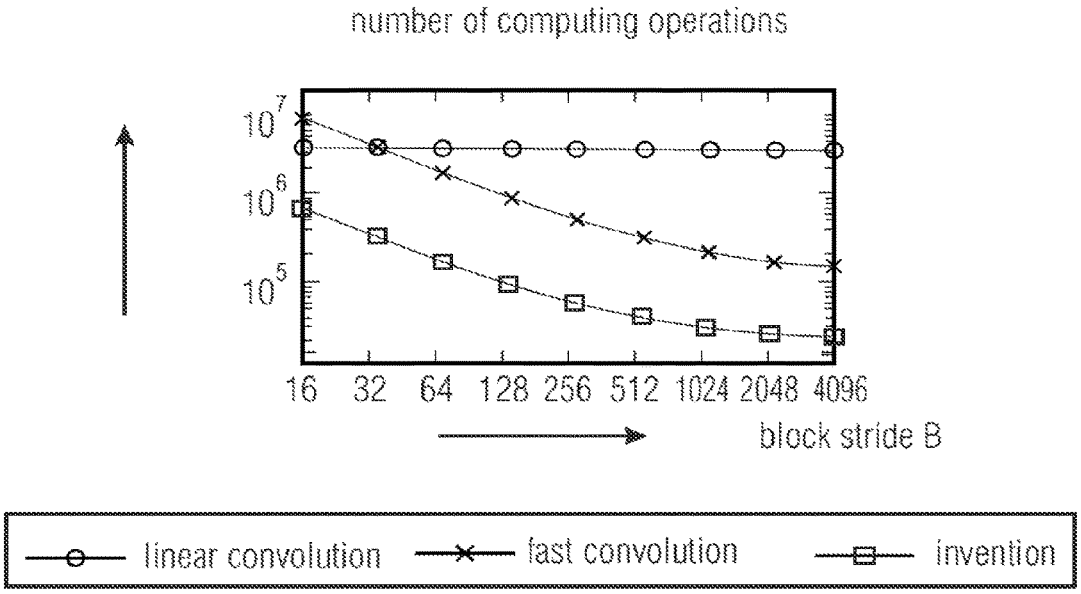

In FIG. 6*d*, the effects of the block delay quantity B for a fixed order of magnitude of filters K is examined. Since linear convolution is not block-oriented, the complexity is constant for this algorithm. It has been observed that the efficiency of the proposed algorithm exceeds that of filter-by-filter fast convolution by an approximately constant factor. This implies that the increased block size L=K+2B−1 as compared to K+B for filter-by-filter fast convolution has no negative effect on the efficiency, irrespective of the block delay.

For the contemplated configuration (N=16, M=16, K=1023, B=1024) and a maximum delay value $D_{max}$=48000, which corresponds to a delay value of one second at a sampling frequency of 48 kHz, the linear convolution algorithms may use approximately $2.9\cdot10^6$ memory words. For the same parameters, the filter-by-filter fast convolution algorithm uses approximately $5.0\cdot10^6$ floating-point memory positions. The increase is due to the size of the pre-calculated frequency domain filter representations. The proposed algorithm may use approximately $8.6\cdot10^6$ words of the memory due to the frequency-domain delay line and to the increased block size for the frequency domain representations of the input signal and of the filters. Thus, the performance improvement of the proposed algorithm as compared to filter-by-filter fast convolution is obtained by an increase in the memory of about 72.7% that may be used. Thus, the proposed algorithm may be regarded as a space-time compromise which uses additional memory in order to store pre-calculated results such as frequency-domain representations of the input signal, for example, so as to enable more efficient implementation.

The additional memory requirements may have an adverse effect on the performance, e.g. due to reduced cache locality. At the same time, it is likely that the reduced number of commands, which implies a reduced number of memory access operations, minimizes this effect. It is therefore useful to examine and evaluate the performance gains of the proposed algorithm for the intended hardware architecture. By analogy therewith, the parameters of the algorithm, such as the FFT block size L or the block delay B, for example, are adjusted to the specific target platform.

Even though specific elements are described as device elements, it shall be noted that this description may equally be regarded as a description of steps of a method, and vice versa.

Depending on the circumstances, the inventive method may be implemented in hardware or in software. Implementation may be effected on a non-transitory storage medium, a digital storage medium, in particular a disc or CD which comprises electronically readable control signals which may cooperate with a programmable computer system such that the method is performed. Generally, the invention thus also consists in a computer program product having a program code, stored on a machine-readable carrier, for performing the method when the computer program product runs on a computer. In other words, the invention may thus be realized as a computer program which has a program code for performing the method, when the computer program runs on a computer.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A device for calculating loudspeaker signals for a plurality of loudspeakers while using a plurality of audio sources, each audio source comprising an audio signal, said device comprising:

a forward transform stage configured to transform each audio signal, block-by-block, to a spectral domain so as acquire for each audio signal a plurality of temporally consecutive short-term spectra;

a memory configured to store a plurality of temporally consecutive short-term spectra for each audio signal;

a memory access controller configured to access a specific short-term spectrum among the plurality of temporally consecutive short-term spectra for a combination comprising a loudspeaker and an audio signal on the basis of a delay value;

a filter stage configured to filter the specific short-term spectrum for the combination of the audio signal and the loudspeaker by using a filter provided for the combination of the audio signal and the loudspeaker, so that a filtered short-term spectrum is acquired for each combination of an audio signal and a loudspeaker;

a summing stage configured to sum up the filtered short-term spectra for a loudspeaker so as acquire summed-up short-term spectra for each loudspeaker; and a backtransform stage configured to backtransform, block-by-block, summed-up short-term spectra for the loudspeakers to a time domain so as acquire the loudspeaker signals.

2. The device as claimed in claim 1, wherein the filter stage is configured to determine, from an impulse response of the filter provided for the combination of the loudspeaker and the audio signal, a modified impulse response in that a number of zeros is inserted at a temporal beginning of the impulse response, the number of zeros depending on the delay value for the combination of the audio signal and the loudspeaker, and on the block index of the specific short-term spectrum for the combination of the audio signal and the loudspeaker.

3. The device as claimed in claim 1, wherein the filter stage is configured to multiply, spectral value by spectral value, the specific short-term spectrum by a transmission function of the filter.

4. The device as claimed in claim 1, wherein the memory comprises, for each audio source, a frequency-domain delay line with an optional access to the short-term spectra stored for said audio source, an access operation being performable via a block index for each short-term spectrum.

5. The device as claimed in claim 1, wherein the forward transform stage comprises a number of transform blocks that is equal to the number of audio sources, wherein the backtransform stage comprises a number of transform blocks that is equal to the number of loudspeaker signals, wherein a number of frequency-domain delay lines is equal to the number of audio sources, and wherein the filter stage comprises a number of single filters that is equal to the product of the number of audio sources and the number of loudspeaker signals.

6. The device as claimed in claim 1, wherein the forward transform stage and the backtransform stage are configured in accordance with an overlap-save method, wherein the forward transform stage is configured to decompose the audio signal into overlapping blocks while using a stride value so as acquire the short-term spectra, and wherein the backtransform stage is configured to discard, following backtransform of the filtered short-term spectra for a loudspeaker, specific areas in the backtransformed blocks and to piece together any portions that have not been discarded, so as acquire the loudspeaker signal for the loudspeaker.

7. The device as claimed in claim 1, wherein the forward transform stage and the backtransform stage are configured in accordance with an overlap-add method, wherein the forward transform stage is configured to decompose the audio signal into adjacent blocks, while using a stride value, which are padded with zeros in accordance with the overlap-add method, a transform being performed with the blocks that have been zero-padded in accordance with the overlap-add method, wherein the backtransform stage is configured to sum up, following the backtransform of the spectra summed up for a loudspeaker, overlapping areas of backtransformed blocks so as acquire the loudspeaker signal for the loudspeaker.

8. The device as claimed in claim 1, wherein the forward transform stage and the backtransform stage are configured to perform a digital Fourier transform algorithm or an inverse digital Fourier transform algorithm.

9. The device as claimed in claim 1, further comprising:

a wave field synthesis operator configured to produce the delay value for each combination of a loudspeaker and an audio source while using a virtual position of the audio source and the position of the loudspeaker, and to provide same to the memory access controller or to the filter stage.

10. The device as claimed in claim 1, wherein the audio source comprises a directional characteristic, the filter stage being configured to use different filters for different combinations of loudspeakers and audio signals.

11. The device as claimed in claim 1, wherein the forward transform stage is configured to use a block-by-block fast Fourier transform, the length of the stage equals K+B, B being a stride in the generation of consecutive blocks, K being an order of the filter of the filter stage when the filter is configured to provide no further contribution to a delay.

12. A method of calculating loudspeaker signals for a plurality of loudspeakers while using a plurality of audio sources, each audio source comprising an audio signal, said method comprising:

transforming each audio signal, block-by-block, to a spectral domain so as acquire for each audio signal a plurality of temporally consecutive short-term spectra;

storing a plurality of temporally consecutive short-term spectra for each audio signal;

accessing a specific short-term spectrum among the plurality of temporally consecutive short-term spectra for a combination comprising a loudspeaker and an audio signal on the basis of a delay value;

filtering the specific short-term spectrum for the combination of the audio signal and the loudspeaker by using a filter provided for the combination of the audio signal and the loudspeaker, so that a filtered short-term spectrum is acquired for each combination of an audio signal and a loudspeaker;

summing up the filtered short-term spectra for a loudspeaker so as acquire summed-up short-term spectra for each loudspeaker; and backtransforming, block-by-block, summed-up short-term spectra for the loudspeakers to a time domain so as acquire the loudspeaker signals.

13. A non-transitory storage medium having stored thereon a computer program comprising a program code for performing a method of calculating loudspeaker signals for a plurality of loudspeakers while using a plurality of audio sources, each audio source comprising an audio signal, when the program code runs on a computer or a processor, the method comprising:

transforming each audio signal, block-by-block, to a spectral domain so as acquire for each audio signal a plurality of temporally consecutive short-term spectra;

storing a plurality of temporally consecutive short-term spectra for each audio signal;

accessing a specific short-term spectrum among the plurality of temporally consecutive short-term spectra for a combination comprising a loudspeaker and an audio signal on the basis of a delay value;

filtering the specific short-term spectrum for the combination of the audio signal and the loudspeaker by using a filter provided for the combination of the audio signal and the loudspeaker, so that a filtered short-term spectrum is acquired for each combination of an audio signal and a loudspeaker;

summing up the filtered short-term spectra for a loudspeaker so as acquire summed-up short-term spectra for each loudspeaker; and backtransforming, block-by-block, summed-up short-term spectra for the loudspeakers to a time domain so as acquire the loudspeaker signals.

* * * * *